US006225036B1

(12) United States Patent
Maskasky et al.

(10) Patent No.: US 6,225,036 B1
(45) Date of Patent: May 1, 2001

(54) COLOR PHOTOGRAPHIC ELEMENT CONTAINING A FRAGMENTABLE ELECTRON DONOR IN COMBINATION WITH A ONE EQUIVALENT COUPLER AND STARCH PEPTIZED TABULAR EMULSION FOR IMPROVED PHOTOGRAPHIC RESPONSE

(75) Inventors: Joe E. Maskasky; Kenneth J. Reed; Victor P. Scaccia; James A. Friday, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/533,732

(22) Filed: Mar. 23, 2000

Related U.S. Application Data

(63) Continuation-in-part of application No. 09/213,766, filed on Dec. 17, 1998, now Pat. No. 6,187,525.

(51) Int. Cl.[7] ..... G03C 1/46

(52) U.S. Cl. ..... 430/505; 430/507; 430/631; 430/639; 430/641; 430/598; 430/599; 430/600; 430/607; 430/611; 430/613; 430/570; 430/572; 430/583; 430/955; 430/543

(58) Field of Search ..... 430/505, 567, 430/631, 639, 641, 598–600, 607, 611, 613, 570, 572, 583, 543, 955

(56) References Cited

U.S. PATENT DOCUMENTS

| | | | | |
|---|---|---|---|---|
| 5,447,819 | * | 9/1995 | Mooberry et al. | 430/955 |
| 5,667,955 | * | 9/1997 | Maskasky | 430/567 |
| 6,054,260 | * | 4/2000 | Adin et al. | 430/583 |

* cited by examiner

*Primary Examiner*—Geraldine Letscher
(74) *Attorney, Agent, or Firm*—Edith A. Rice

(57) ABSTRACT

A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said emulsion layers comprises tabular grains having {111} major faces containing greater than 50 mole percent bromide, and accounting for greater than 50 percent total grain projected area precipitated in a peptizer that is a water dispersible cationic starch, and contains a fragmentable electron donating sensitizer.

18 Claims, No Drawings

COLOR PHOTOGRAPHIC ELEMENT CONTAINING A FRAGMENTABLE ELECTRON DONOR IN COMBINATION WITH A ONE EQUIVALENT COUPLER AND STARCH PEPTIZED TABULAR EMULSION FOR IMPROVED PHOTOGRAPHIC RESPONSE

CROSS-REFERENCE TO RELATED APPLICATION

This is a continuation-in-part of application Serial No. 09/213,766, filed Dec. 17, 1998 now U.S. Pat. No. 6,187,525, entitled "COLOR PHOTOGRAPHIC ELEMENTS OF INCREASED SENSITIVITY CONTAINING ONE EQUIVALENT COUPLER", by Maskasky et al., the entire disclosures of which are incorporated herein by reference.

FIELD OF THE INVENTION

The invention relates to color photography. More specifically, the invention relates to color photographic elements that contain layer units that contain radiation-sensitive silver halide emulsions and produce dye images.

DEFINITIONS

A tabular grain emulsion is one in which at least 50 percent of total grain projected area is accounted for by tabular grains.

As employed herein the term "tabular grain" is employed to indicate grains that have two parallel major faces substantially larger than any remaining face and that exhibit an aspect ratio of at least 2.

Aspect ratio is the ratio of tabular grain equivalent circular diameter (ECD) divided by thickness (t). The average aspect ratio of a tabular grain emulsion is the ratio of average grain ECD divided by average grain thickness.

A 3D emulsion is one in which at least 50 percent of total grain projected area is accounted for by 3D grains. As used herein, the term "3D grain" refers to non-tabular morphologies, for example cubes, octahedra, rods and spherical grains, and to tabular grains having an aspect ratio of less than 2.

In referring to grains and emulsions containing two or more halides, the halides are named in order of descending concentrations.

As used herein, the term "one equivalent couplers" refers to imaging couplers where a preformed dye in a shifted state is linked to the coupling position of the coupler. The dye image comprises the coupler derived azomethine dye and the released dye which have essentially the same hue.

BACKGROUND OF THE INVENTION

It is a long-standing objective of color photographic origination materials to maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light sensitive silver halide emulsions in such systems is determined by the grain size of the emulsions. Larger emulsions capture more light. For tabular emulsions, the photographic speed would be proportional to the projected area (or diameter, d squared)-see for example James "The Theory of the Photographic Process" $4^{th}$ ed. p 105 (where the photographic speed is measured as some threshold density value). In color photographic elements, upon development, the captured light is ultimately converted into dye deposits which constitute the reproduced image. However, the granularity expressed by these dye deposits is directly proportional to the grain size of the silver halide emulsion . Again for tabular emulsions, granularity is generally proportional to the square root of the grain area ie proportional to the grain diameter, d (James "The Theory of the Photographic Process" $4^{th}$ ed. p 625).

Thus, larger silver halide emulsion grains have higher sensitivity to light (proportional to $d^2$) but also lead to higher granularity in the reproduced image (proportional to d). It has been a long-standing problem to provide materials which maximize the response to light of a silver halide emulsion for any given grain size.

The problem of maximizing response of the emulsion grain to light is particularly important for the blue sensitive emulsions of high speed materials, since standard scene illuminants are at least somewhat deficient in blue light. As a result, 3D AgBrI emulsions with light absorption enhanced by high iodide content are generally employed in the fast yellow emulsion layer of the highest speed color photographic films. Unfortunately, these large fast yellow 3D emulsions scatter light in a very diffuse (sideways) manner and thereby compromise the acutance of underlying light sensitive layers. Tabular grains as fast yellow emulsions offer advantages for acutance of underlying layers due to the specular manner (forward direction) in which they scatter light but up until now have been deficient for adequate speed/granularity. Here our usage of the term acutance is that generally offered in standard reference works such as James "The Theory of the Photographic Process" $4^{th}$ ed. Pp 602–607.

It is of particular interest to find solutions to this problem for large emulsions with the potential for providing high speed (preferably ISO 400 or greater) color photographic materials. Such high speed materials have a number of potential applications. They are particularly valuable for use in cameras with zoom lenses and in single use cameras (also called "film with lens" units). Zoom lenses generally have smaller apertures (higher f-numbers) than comparable fixed focus lenses. Thus, zoom lenses, while giving increased flexibility in composition of a pictorial scene, deliver less light to the camera film plane. Use of high speed films allows the flexibility of zoom lenses while still preserving picture taking opportunities at low light levels. In single use cameras, lens focus is fixed. Here, high speed films allow use of a fixed aperture having a higher f-number, thus increasing the available depth of field, an important feature in a fixed focus camera. For single use cameras with flash, higher film speed allows pictures to be taken with a less energetic flash, enabling more economical manufacture of the single use unit.

A dramatic increase in photographic speeds in silver halide photography began with the introduction of tabular grain emulsions into silver halide photographic products in 1982. A tabular grain is one which has two parallel major faces that are clearly larger than any other crystal face and which has an aspect ratio of at least 2. Tabular grain emulsions are those in which tabular grains account for greater than 50 percent of total grain projected area. Kofron et al U.S. Pat. No. 4,439,520 illustrates the first chemically and spectrally sensitized high aspect ratio (average aspect ratio >8) tabular grain emulsions. In their most commonly used form tabular grain emulsions contain tabular grains that have major faces lying in {111 } crystal lattice planes and contain greater than 50 mole percent bromide, based on silver. A summary of tabular grain emulsions is contained in *Research Disclosure,* Item 38957, I. Emulsion grains and their preparation, B. Grain morphology, particularly subparagraphs (1) and (3).

The use of cationic starch as a peptizer for the precipitation of high bromide {111} tabular grain emulsions is taught by Maskasky U.S. Pat. Nos. 5,604,085, 5,620,840, 5,667,955, 5,691,131, and 5,733,718. Oxidized cationic starches are advantageous in exhibiting lower levels of viscosity than gelatino-peptizers. This facilitates mixing. Under comparable levels of chemical sensitization higher photographic speeds can be realized using cationic starch peptizers. Alternatively, speeds equal to those obtained using gelatino-peptizers can be achieved at lower precipitation and/or sensitization temperatures, thereby avoiding unwanted grain ripening.

To increase the speed of silver halide emulsions independent of spectral sensitization, the grain surfaces are treated with chemical sensitizers. A summary of chemical sensitizers is provided by *Research Disclosure,* Item 38957, cited above, IV. Chemical sensitization.

It has been recently recognized that a further enhancement in photographic speed can be realized by associating with the silver halide grain surfaces a fragmentable electron donating (FED) sensitizer. While no proof of the mechanism of FED sensitization has yet been generated, one plausible explanation is as follows: When, as noted above, photon capture within a grain results in electron promotion from a valence shell to a conduction energy band, a common loss factor is recombination. That is, the promoted electron simply returns to a hole in the valence shell, created by promotion to the conduction band of the same or another electron. When recombination occurs, the energy of the captured photon is dissipated without contributing to latent image formation. It is believed that the FED sensitizer reduces recombination by donating an electron to fill the hole created by photon capture. Thus, fewer conduction band electrons return to hole sites in valence bands and more electrons are available to participate in latent image formation.

When the FED sensitizer donates an electron to a silver halide grain, it fragments, creating a cation and a free radical. The free radical is a single atom or compound that contains an unpaired valence shell electron and is for that reason highly unstable. If the oxidation potential of the free radical is equal to or more negative than −0.7 volt, the free radical immediately upon formation injects a second electron into the grain to eliminate its unpaired valence shell electron. When the free radical also donates an electron to the grain, it is apparent that absorption of a single photon in the grain has promoted an electron to the conduction band, stimulated the FED sensitizer to donate an electron to file the hole left behind by the promoted electron, thereby reducing hole-electron recombination, and injected a second electron. Thus, the FED sensitizer contributes one or two electrons to the silver grain that contribute directly or indirectly to latent image formation.

FED sensitizers and their utilization for increasing photographic speed are disclosed in U.S. Pat. Nos. 5,747,235, 5,747,236, 5,994,051, and 6,010,841, and published European Patent Applications 893,731 and 893,732.

When silver halide grains are developed, the light exposed (as opposed to the non-exposed) silver halide grains are selectively reduced with a developing agent. During this reaction silver halide is reduced to silver, and the developing agent is oxidized. When it is desired to form a dye image, the developing agent is usually chosen to be a color developing agent, which is a developing agent that, following oxidization, reacts to complete an image dye chromophore. The most common route to image dye formation is the reaction of an image dye-forming coupler with apara-phenylenediamine color developing agent, which is apara-phenylenediamine in which at least one of the amine groups is unsubstituted. Dye chromophore formation occurs when one or two quinonediimine molecules (each of which requires two molecules of oxidized para-phenylenediamine color developing agent to produce) reacts with the image dye-forming coupler. When an image dye-forming coupler requires two quinonediimine molecules to form an image dye molecule, the image dye-forming coupler is said to be a four equivalent coupler, since four molecules of color developing agent must be oxidized to result in each molecule of image dye. Two equivalent coupler image dye-forming couplers are those that spontaneously split off an anionic (e.g., halogen) or low pKa leaving group (e.g., phenol or heterocycle) under the conditions of development and therefore react with a single quinonediimine molecule to form an image dye molecule. These mechanisms of image dye formation are textbook knowledge, as illustrated by the Color Photography topic in *The Kirk-Othmer Encyclopedia of Chemical Technology,* John Wiley and Sons, New York, 1993; Vol. 6.

Since the molar ratio of image dye produced to developed silver is lower when a four equivalent image dye-forming coupler is employed than when a two equivalent image dye-forming coupler is employed and since the photographic speeds of color photographic elements are compared by measuring the exposure difference required to reach a reference image dye density, it is apparent that otherwise comparable color photographic elements containing two equivalent image dye-forming couplers exhibit higher imaging speeds than those that contain four equivalent image dye-forming couplers. This recognition led to investigation of one equivalent image dye-forming couplers. One equivalent image dye-forming couplers are similar to two equivalent image dye-forming couplers in that only one quinonediimine molecule is required to form an image dye molecule. One equivalent couplers differ from two equivalent couplers in that the leaving group that is split off prior to coupling itself supplies a molecule of image dye which is in addition to the molecule of image dye produced by coupling. Hence, reduction of two molecules of silver halide to silver produces two molecules of oxidized para-phenylenediamine color developing, which produce one molecule of quinonediimine that reacts with a one equivalent coupler to produce two image dye molecules. Hence, in theory there is a one to one molar ratio of developed silver to image dye. The unique requirements imposed by dye chromophore containing leaving groups in one equivalent image dye-forming couplers have limited their application, with two and four equivalent structures forming the overwhelming majority of image dye-forming couplers. One equivalent image dye-forming couplers are described in Mooberry et al U.S. Pat. Nos. 4,840,884, 5,447,819 and 5,457,004.

PROBLEM TO BE SOLVED BY THE INVENTION

The problem of maximizing response of the emulsion grain to light is particularly important for the blue sensitive emulsions of high speed materials since tungsten illumination is deficient in blue light. As a result, 3D AgBrI emulsions with light absorption enhanced by high iodide content are generally employed in the fast yellow emulsion layer of the highest speed color photographic films. Unfortunately, these large fast yellow 3D emulsions also compromise the acutance of underlying layers. Further, high speed motion imaging products are usually tungsten balanced and thus require particularly high blue sensitivity to compensate for blue light deficiency. However, the granularity accompanying these high speed blue sensitive emulsions is a concern for blue screen special effects applications that have a need for reduced blue granularity.

SUMMARY OF THE INVENTION

A photographic recording element comprised of a support and at least one dye image forming layer unit containing (a) radiation-sensitive silver halide grains, (b) sensitizer for the silver halide grains, (c) peptizer for the silver halide grains, and (d) at least one dye image providing coupler, wherein (a) the radiation-sensitive silver halide grains include tabular grains (1) having {111} major faces, (2) containing greater than 50 mole percent bromide, based on silver, and (3) accounting for greater than 50 percent total grain projected area, (b) the sensitizer includes a fragmentable electron donating sensitizer, (c) the peptizer is a water dispersible cationic starch, and (d) the dye image providing coupler is a one equivalent image dye-forming coupler.

In comparing high bromide {111} tabular grain emulsions precipitated in the presence of a cationic starch peptizer and sensitized with a fragmentable electron donating (FED) sensitizer with an otherwise similar emulsion that contains a gelatino-peptizer, the starch peptized emulsions have been observed to exhibit significantly higher speeds than the gelatin peptized emulsions. When the comparisons are repeated, but with the FED sensitizer removed, a relatively small speed advantage is observed for the starch peptized emulsions. The larger speed advantage realized by FED sensitizer addition to starch peptized high bromide {111} tabular grain emulsions was entirely unexpected. This speed advantage is reported in this application and in Applications D78203 and D78505 cited above.

In addition, the photographic elements of this invention exhibit a further increase in imaging speed attributable to the incorporation of one equivalent image-dye forming coupler. If the image dye supplied by the leaving group of a one equivalent coupler is as light absorptive as the dye chromophore formed by coupling, the one equivalent coupler produces an image dye density twice that produced by the same molar coating coverage of a two equivalent coupler and four times that produced by the same molar coating coverage of four equivalent coupler. However, even larger increases in image dye density are possible based on comparable molar coating coverages, since the leaving group can be formed to contain dye chromophores that are much more light absorptive than the dyes formed by the coupling reaction. Stated another way, the larger degree of structural freedom imparted by incorporating a dye chromophore in a leaving group as opposed to forming a dye chromophore by reacting a quinonediimine with a coupler allows leaving group dye chromophores to be selected that can account for the majority of dye image light absorption. If it is desired to merely equal the imaging speeds realizable with two equivalent image dye-forming couplers, then the molar coating coverages of the one equivalent image dye-forming couplers can be reduced well below half the molar coating coverages required to form a dye image using a comparable two equivalent image dye-forming coupler.

One aspect of this invention comprises a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said layers comprises starch peptized tabular grains and contains a one-equivalent image-dye forming coupler and a fragmentable electron donating (FED) sensitizer. The FED sensitizer is preferable a compound of the formula: X-Y' or a compound which contains a moiety of the formula -X-Y'; wherein X is an electron donor moiety, Y' is a leaving proton H or a leaving group Y, with the proviso that if Y' is a proton, a base, $\beta^-$, is present is said emulsion layer or is covalently linked directly or indirectly to X, and wherein:

1) X-Y' has an oxidation potential between 0 and about 1.4 V; and
2) the oxidized form of X-Y' undergoes a bond cleavage reaction to give the radical $X^\bullet$ and the leaving fragment Y'; and, optionally,
3) the radical $X^\bullet$ has an oxidation potential $\leqq -0.7$ V (that is, equal to or more negative than about −0.7 V).

ADVANTAGEOUS EFFECT OF THE INVENTION

Starch peptized tabular grains as fast yellow emulsions in accordance with this invention offer advantages for acutance of underlying layers that is not achieved by the conventional use of 3D emulsions in the fast yellow layer. Furthermore, these advantages can be achieved at dramatically lower coated silver halide emulsion laydowns. Further, high speed imaging products in accordance with this invention overcome the low blue speed associated with tungsten light sources. Further, high speed motion picture imaging products, in accordance with this invention, improve the blue granularity in applications using blue screen special effects. In addition, the use of one-equivalent couplers in accordance with this invention enables developability and read out of speed for large, fast tabular grains. Starch peptized tabular grain emulsions offer a low Dmin thereby enabling the effective use of one equivalent coupler chemistry.

DETAILED DESCRIPTION OF THE INVENTION

The photographic element of this invention comprises tabular grain silver halide emulsions. Tabular grains are those with two parallel major faces each clearly larger than any remaining grain face and tabular grain emulsions are those in which the tabular grains account for at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (I), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 μm. The tabular grains preferably have an average equivalent circular diameter of at least 2 μm, more preferably at least 2.5 μm, and most preferably at least 3 μm.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I,* Section I.B.(3) (page 503).

The silver halide grains to be used in the invention may be prepared according to methods known in the art, such as those described in *Research Disclosure I* and James, *The Theory of the Photographic Process.* These methods generally involve mixing a water soluble silver salt with a water soluble halide salt in the presence of a protective colloid, and controlling the temperature, pAg, pH values, etc, at suitable values during formation of the silver halide by precipitation.

The protective colloid or peptizer of choice is water dispersible, cationic starch. The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch or high amylose corn starch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

(I)

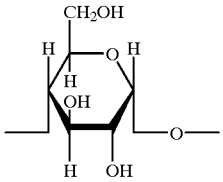

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic-that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be usefull as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

It is preferred to employ an oxidized cationic starch. The starch can be oxidized before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and preferred. While any convenient oxidizing agent counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are usually at the 2 and 3 position carbon atoms forming the α-D-glucopyranose ring. The 2 and 3 position

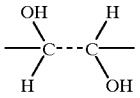

groups are commonly referred to as the glycol groups. The carbon-to-carbon bond between the glycol groups is replaced in the following manner:

(II)

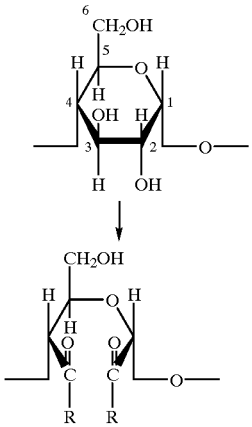

where R represents the atoms completing an aldehyde group or a carboxyl group.

The hypochlorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the high bromide {111} tabular grain emulsions—e.g., up to a pBr of 3.0.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.,* Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.,* Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science,* Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science: Part A,* Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science,* Vol. 18, pp. 389–399 (1974); R. L. Whistler, J. N. Bemiller and E. F. Paschall, *Starch: Chemistry and Technology,* Chapter X, Starch Derivatives: Production and Uses, II. Hypochlorite-Oxidized Starches, pp. 315–323, Academic Press, 1984; and O. B. Wurzburg, *Modified Starches: Properties and Uses,* III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can J Chem.,* Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.,* 1953, pp. 3631–3635; P. J. Borchert and J. Mirza, "Cationic Dispersions of Dialdehyde Starch I. Theory and Preparation", *Tappi,* Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.,* pp. 2121–2127 (1966); and O. B. Wurzburg, *Modified Starches: Properties and Uses,* III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.,* Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

The water dispersible cationic starch is present during the precipitation (during nucleation and grain growth or during grain growth) of the high bromide {111} tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures, here incorporated by reference, are specifically contemplated to be usefull in the practice of the invention, subject to the selected peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain at least 70 (optimally at least 90) mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent, based on silver, or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent, based on silver. It is generally preferred that the iodide concentration be less than 20 mole percent, based on silver. Typically the iodide concentration is less than 10 mole percent, based on silver. To facilitate rapid processing, such as commonly practiced in radiography, it is preferred that the iodide concentration be limited to less than 4 mole percent, based on silver. Significant photographic advantages can be realized with iodide concentrations as low as 0.5 mole percent, based on silver, with an iodide concentration of at least 1 mole percent, based on silver, being preferred.

The high bromide {111} tabular grain emulsions can exhibit mean grain ECD's of any conventional value, ranging up to 10 μm, which is generally accepted as the maximum mean grain size compatible with photographic utility. In practice, the tabular grain emulsions of the invention typically exhibit a mean ECD in the range of from about 0.2 to 7.0 μm. Tabular grain thicknesses typically range from about 0.03 μm to 0.3 μm. For blue recording somewhat thicker grains, up to about 0.5 μm, can be employed. For minus blue (red and/or green) recording, thin (<0.2 μm) tabular grains are preferred.

The advantages that tabular grains impart to emulsions generally increases as the average aspect ratio or tabularity of the tabular grain emulsions increases. Both aspect ratio (ECD/t) and tabularity ($ECD/t^2$, where ECD and t are measured in μm) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 μm (preferably less than 0.2 μm and optimally less than 0.07 μm) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred.

High bromide {111} tabular grain emulsions precipitated in the presence of a cationic starch are disclosed in the following patents, the disclosures of which are here incorporated by reference: Maskasky U.S. Pat. Nos. 5,604,085, 5,620,840, 5,667,955, 5,691,131, and 5,733,718.

Conventional dopants can be incorporated into the tabular grains during their precipitation, as illustrated by the patents cited above and *Research Disclosure,* Item 38957, cited above, Section I. Emulsion grains and their preparation, D. Grain modifying conditions and adjustments, paragraphs (3), (4) and (5). It is specifically contemplated to incorporate shallow electron trapping (SET) site providing dopants in the tabular grains, further disclosed in *Research Disclosure,* Vol. 367, November 1994, Item 36736, and Olm et al U.S. Pat. No. 5,576,171, here incorporated by reference.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501 and Daubendiek et al U.S. Pat. Nos. 5,573,902 and 5,576,168, here incorporated by reference.

Although epitaxy onto the host tabular grains can itself act as a sensitizer, the emulsions of the invention show sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure,* Item 38957, cited above, Section IV. Chemical sensitizations. It is preferred to employ at least one of noble metal (typically gold) and middle chalcogen (typically sulfur) and, most preferably, a combination of both in preparing the emulsions of the invention for photographic use. The use of a cationic starch peptizer allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C, as described in

*Research Disclosure I,* Section IV (pages 510–511) and the references cited therein.

In accordance with this invention the silver halide emulsion contains a fragmentable electron donating (FED) compound which enhances the sensitivity of the emulsion. The fragmentable electron donating compound is of the formula X-Y' or a compound which contains a moiety of the formula -X-Y'; wherein X is an electron donor moiety, Y' is a leaving proton H or a leaving group Y, with the proviso that if Y' is a proton, a base, $\beta^-$, is covalently linked directly or indirectly to X, and wherein:

1) X-Y' has an oxidation potential between 0 and about 1.4 V; and
2) the oxidized form of X-Y' undergoes a bond cleavage reaction to give the radical $X^\bullet$ and the leaving fragment Y';

and, optionally, 3) the radical $X^\bullet$ has an oxidation potential $\leqq -0.7$ V (that is, equal to or more negative than about −0.7 V).

Compounds wherein X-Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions that are believed to take place when X-Y undergoes oxidation and fragmentation to produce a radical $X^\bullet$, which in a preferred embodiment undergoes further oxidation.

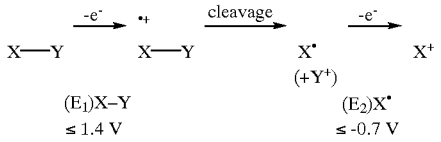

where $E_1$ is the oxidation potential of X-Y and $E_2$ is the oxidation potential of the radical $X^\bullet$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In certain embodiments of the invention the oxidation potential, $E_2$, of the radical $X^\bullet$ is equal to or more negative than −0.7 V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X-Y are defined by the characteristics of the two parts, namely the fragment X and the fragment Y. The structural features of the fragment X determine the oxidation potential of the X-Y molecule and that of the radical $X^\bullet$, whereas both the X and Y fragments affect the fragmentation rate of the oxidized molecule $X\text{-}Y^{\bullet+}$.

In embodiments of the invention in which Y' is H, the following represents the reactions believed to take place when the compound X-H undergoes oxidation and deprotonation to the base, $\beta^-$, to produce a radical $X^\bullet$, which in a preferred embodiment undergoes further oxidation.

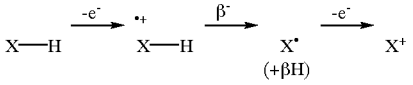

Preferred X groups are of the general formula:

(I)

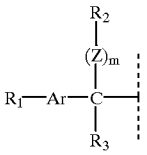

(II)

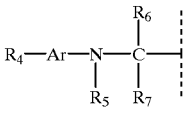

(III)

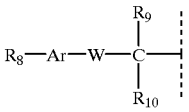

or (IV)

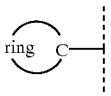

The symbol "R" (that is R without a subscript) is used in all structural formulae in this patent application to represent a hydrogen atom or an unsubstituted or substituted alkyl group.

In structure (I):

m=0, 1;

Z=O,S,Se,Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, SO2R, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

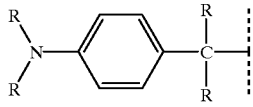

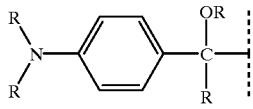

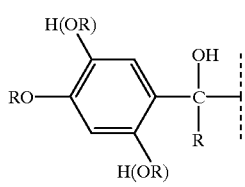

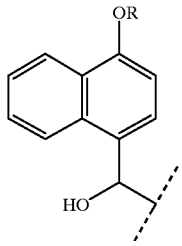

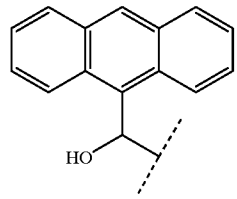

-continued

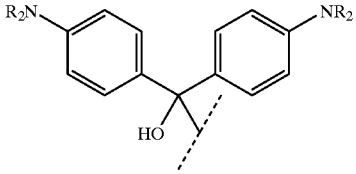

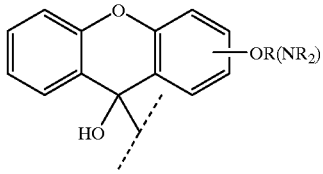

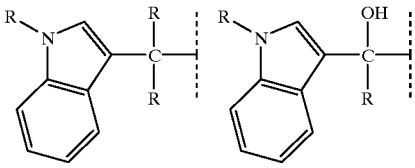

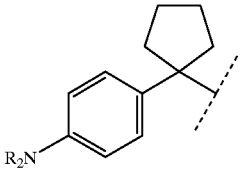

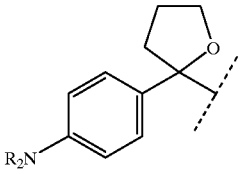

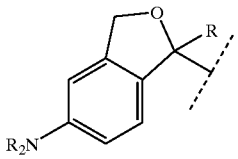

In the structures of this patent application a designation such as —OR($NR_2$) indicates that either —OR or —$NR_2$ can be present.

The following are illustrative examples of the group X of general structure II:

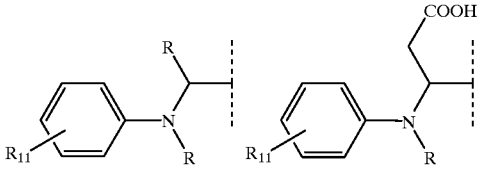

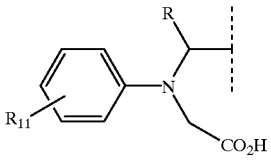

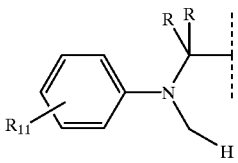

-continued

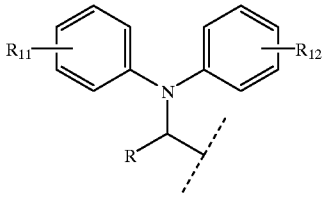

$R_{11}$ and $R_{12}$ = { H, alkyl, alkoxy, alkylthio, halo, carbamoyl; carboxyl, amido, formyl, sulfonyl, sulfonamido, nitrile }

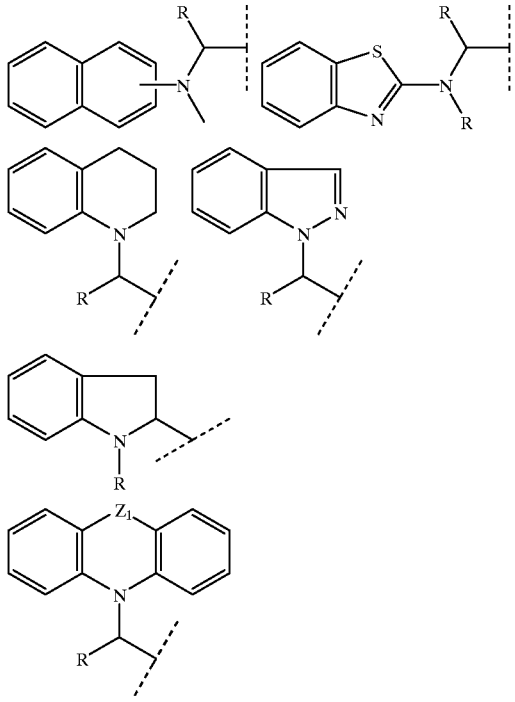

$Z_1$=a covalent bond, S, O, Se, NR, $CR_2$, CR=CR, or $CH_2CH_2$.

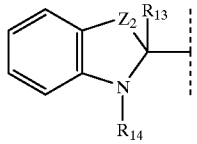

$Z_2$=S, O, Se, NR, $CR_2$, CR=CR, $R_{13}$, =alkyl, substituted alkyl or aryl, and $R_{14}$=H, alkyl substituted alkyl or aryl.

The following are illustrative examples of the group X of the general structure III:

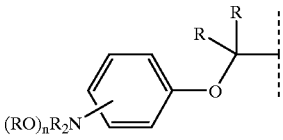

-continued

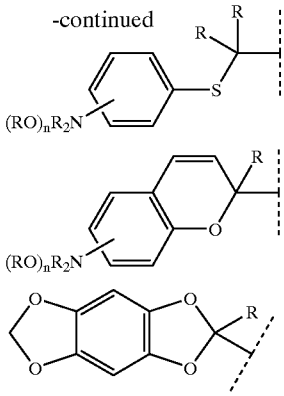

n=1–3

The following are illustrative examples of the group X of the general structure IV:

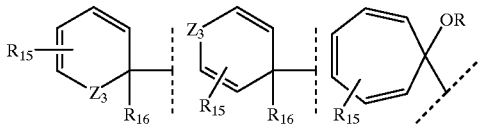

$Z_3$=O, S, Se, NR $R_{15}$=R, OR, $NR_2$ $R_{16}$=alkyl, substituted alkyl

Preferred Y' groups are:

(1) X', where X' is an X group as defined in structures I–IV and may be the same as or different from the X group to which it is attached (2)

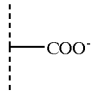

(3)

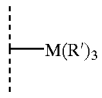

where M = Si, Sn or Ge; and R′ = alkyl or substituted alkyl (4)

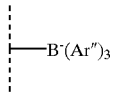

where Ar″ = aryl or substituted aryl (5)

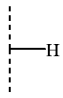

In preferred embodiments of this invention Y' is —H, —$COO^-$ or —$Si(R')_3$ or -X'. Particularly preferred Y groups are —H, —$COO^-$ or —$Si(R')_3$.

In embodiments of the invention in which Y' is a proton, a base, $\beta^-$; is covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE I
| pKa's in water of the conjugate acids of some useful bases | | | |
|---|---|---|---|
| $CH_3—CO_2^-$ | 4.76 | $CH_3—COS^-$ | 3.33 |
| $C_2H_5—CO_2^-$ | 4.87 | 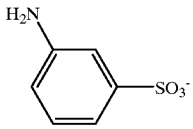 | 3.73 |
| $(CH_3)_2CH–CO_2^-$ | 4.84 | 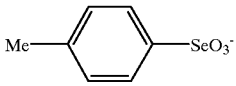 | 4.88 |
| $(CH_3)_3C—CO_2^-$ | 5.03 | 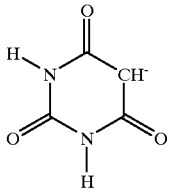 | 4.01 |
| $HO—CH_2—CO_2^-$ | 3.83 | 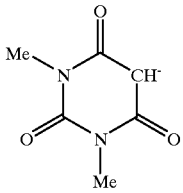 | 4.7 |
| 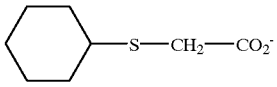 | 3.48 | $(CH_3)_3\overset{+}{N}—\overset{-}{O}$ | 4.65 |
| $CH_3—CO—NH—CH_2—CO_2^-$ | 3.67 | $H_2N—CH_2—CH(CH_3)—\overset{+}{N}H_3$ | 6.61 |
| 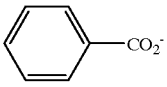 | 4.19 | 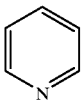 | 5.25 |
| 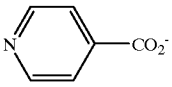 | 4.96 | 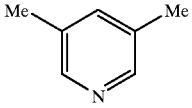 | 6.15 |
| | | 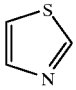 | 2.44 |
| | | 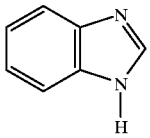 | 5.53 |
Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$Z\text{-}(L\text{-}X\text{-}Y')_k$ $A\text{-}(L\text{-}X\text{-}Y')_k$ $(A\text{-}L)_k\text{-}X\text{-}Y'$ $Q\text{-}X\text{-}Y'$ $A\text{-}(X\text{-}Y')_k$ $(A)_k\text{-}X\text{-}Y'$ $Z\text{-}(X\text{-}Y')_k$ or $(Z)_k\text{-}X\text{-}Y'$ Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X-Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

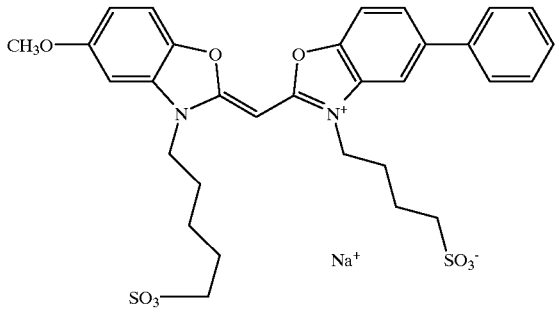

-continued

Dye 2

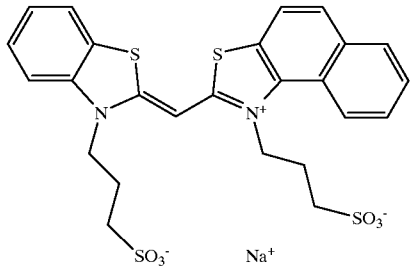

Dye 3

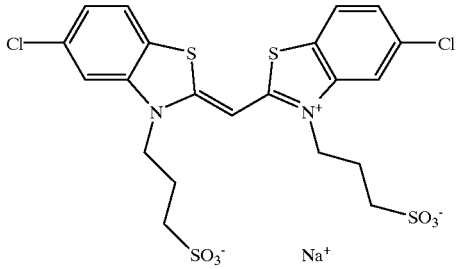

Dye 4

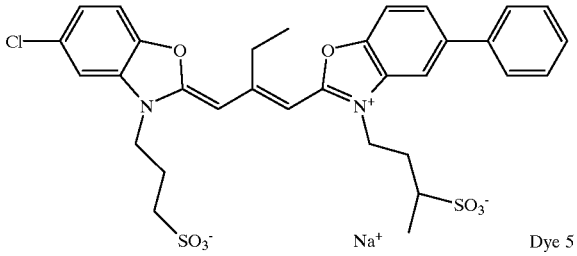

Dye 5

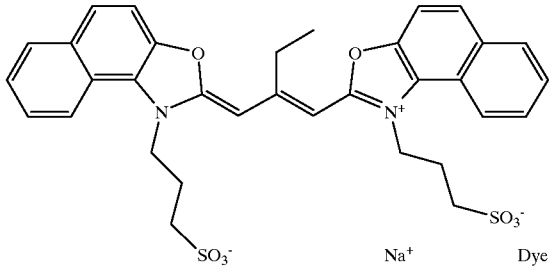

Dye 6

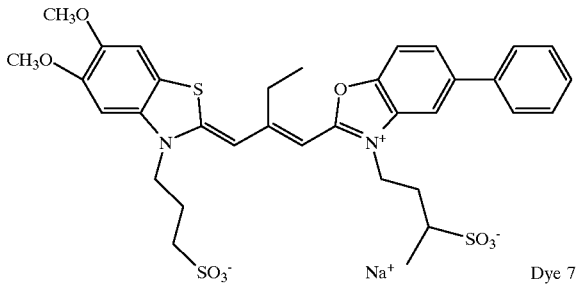

Dye 7

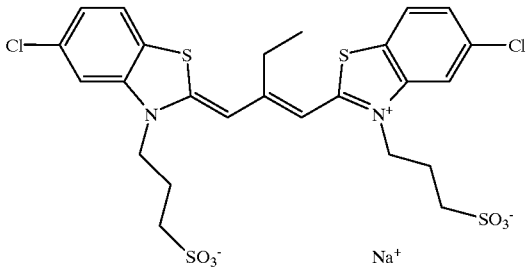

-continued and

Dye 8

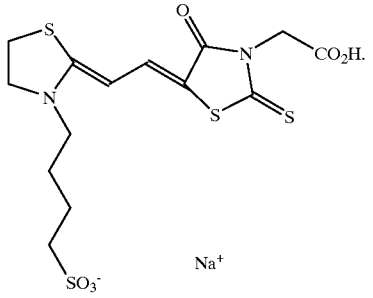

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

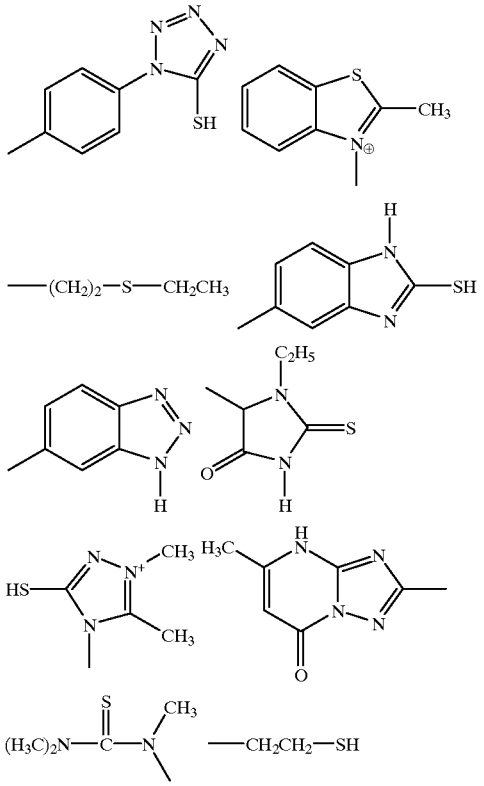

and

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects by a covalent bond the light absorbing group Z or the silver halide adsorbing group A to the fragmentable electron donating group XY is preferably an organic linking group containing a least one C, N, S, or O atom. It is also desired that the linking group not be completely aromatic or unsaturated, so that a pi-conjugation system cannot exist between the Z and XY or the A and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

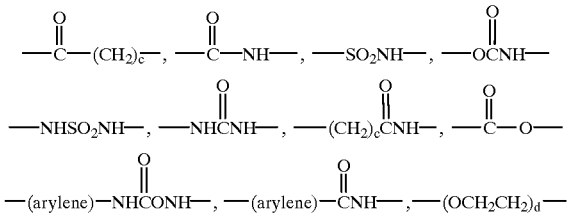

where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

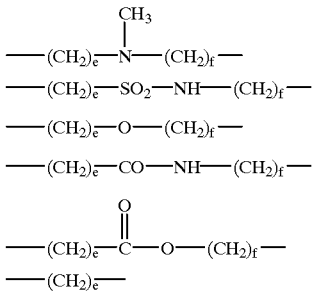

e and f=1–30, with the proviso that e+f≦31

Q represents the atoms necessary to form a chromophore comprising an amidinium-ion, a carboxyl-ion or dipolar-amidic chromophoric system when conjugated with X-Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

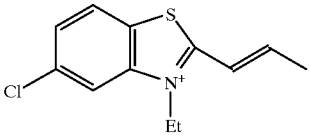

-continued

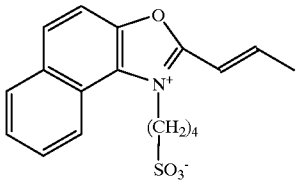

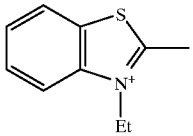

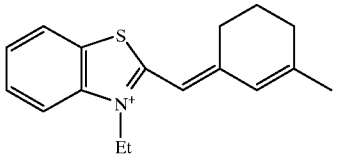

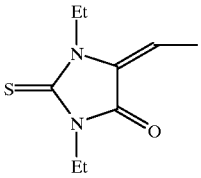

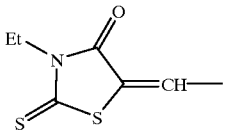

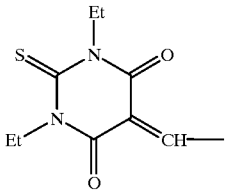

-continued

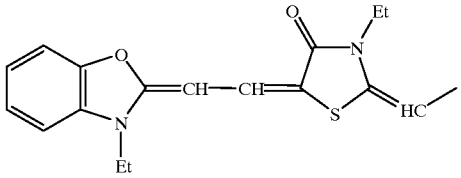

Particularly preferred are Q groups of the formula:

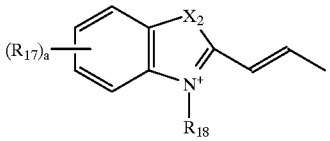

wherein:

$X_2$ is O, S, N, or $C(R_{19})$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4;

and $R_{18}$ is substituted or unsubstituted alkyl, or substituted or unsubstituted aryl.

Illustrative fragmentable electron donating compounds include:

FED 1

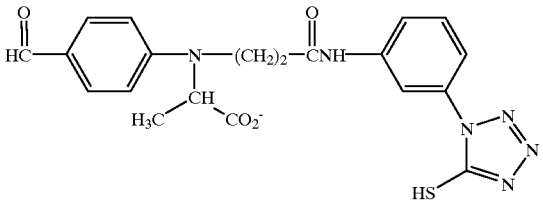

FED 2

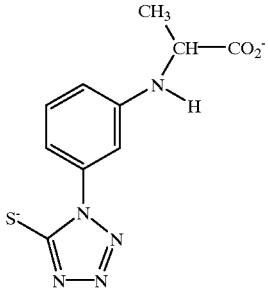

-continued
FED 3
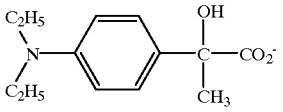
FED 4
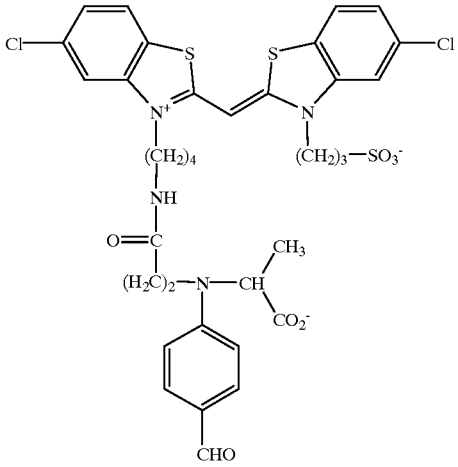
FED 5
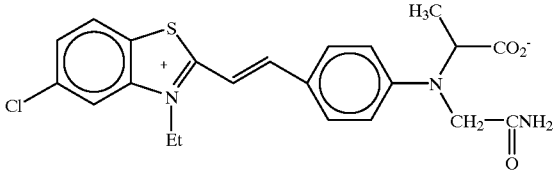
FED 6
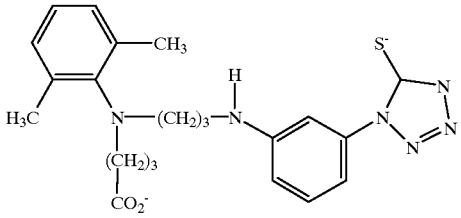
FED 7
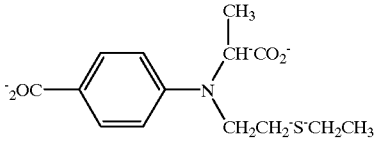
FED 8
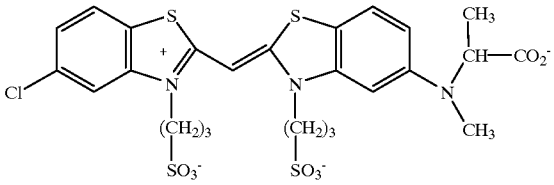
FED 9
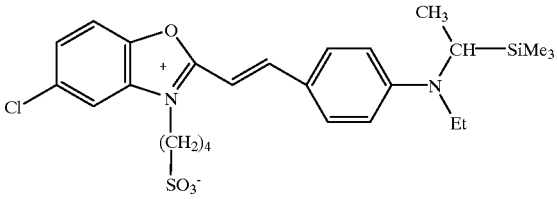
FED 10
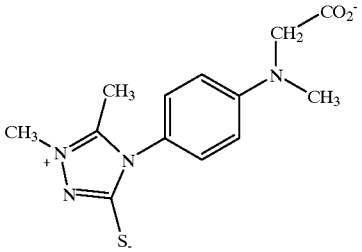
FED 11
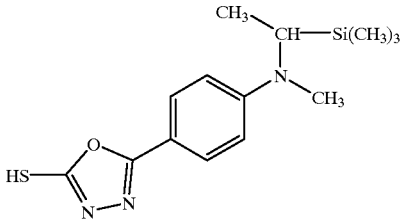
FED 12
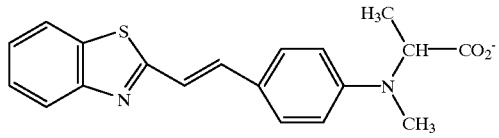

-continued
FED 13
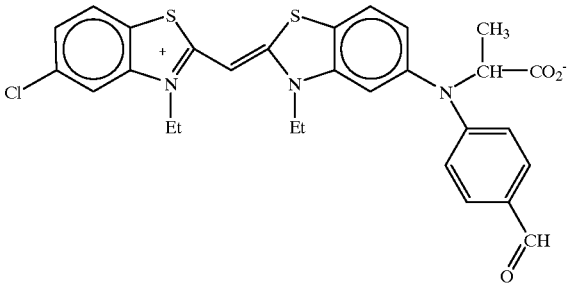
FED 14
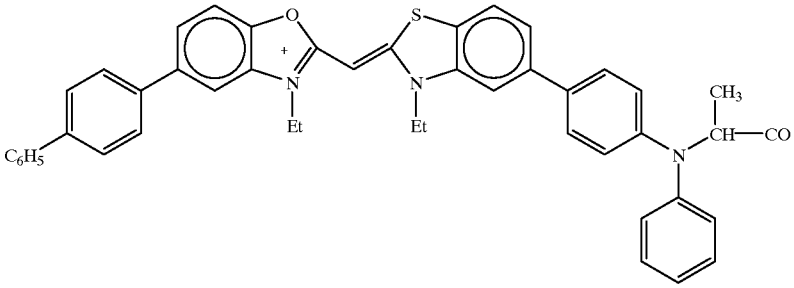
FED 15
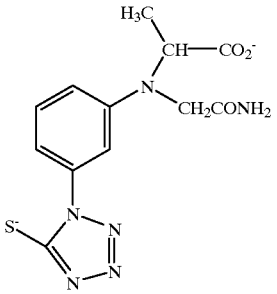
FED 16
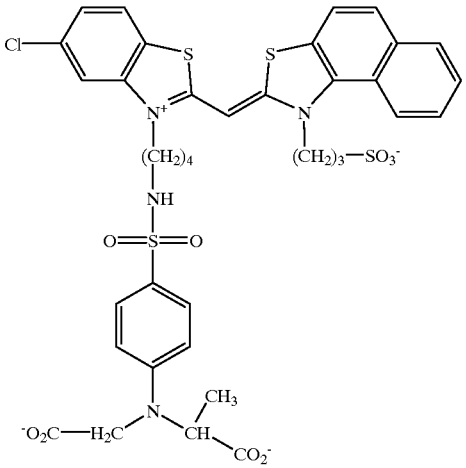
FED 17
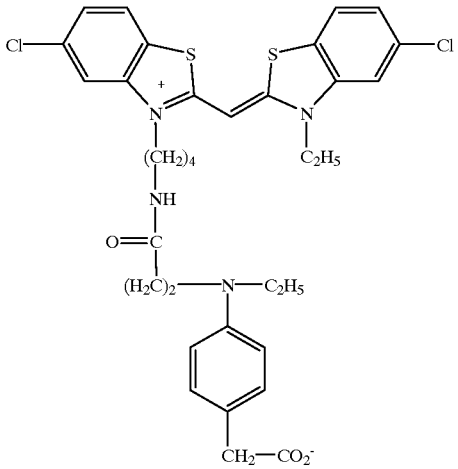
FED 18
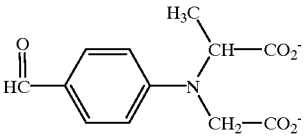

-continued

FED 19

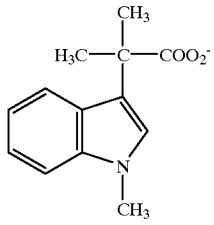

FED 20

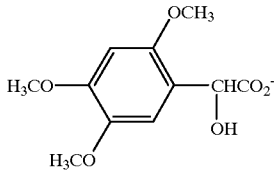

FED 21

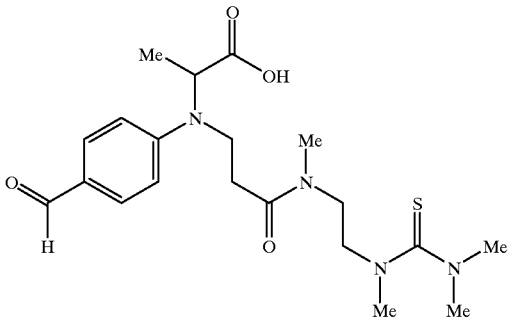

FED 22

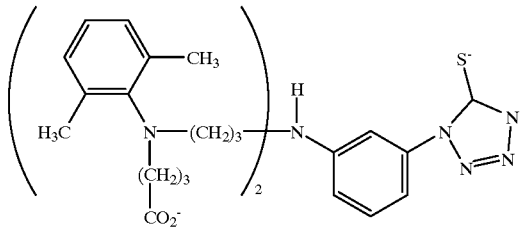

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed. For fragmentable one-electron donors relatively larger amounts per mole of silver are also employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Fragmentable electron donating compounds are described more fully in U.S. Pat. Nos. 5,747,235, 5,747,236, 5,994,051, and 6,010,841, and published European Patent Applications 893,731 and 893,732, the entire disclosures of these patents and patent applications are incorporated herein by reference.

In addition to high bromide {111} tabular grains, cationic starch peptizer, and FED sensitizer, usually in combination with conventional chemical and/or spectral sensitizers, the emulsions of the invention additionally preferably include one or more conventional antifoggants and stabilizers. A summary of conventional antifoggants and stabilizers is contained in *Research Disclosure,* Item 38957, VII. Antifoggants and stabilizers.

It has been observed that employing a FED sensitizer in combination with a cationic starch peptizer results in somewhat higher minimum densities than when a gelatino-peptizer is substituted, even when conventional antifoggants and stabilizers are present in the emulsion. It has been discovered that this incremental increase in minimum density can be reduced or eliminated treating the emulsion with an oxidizing agent during or subsequent to grain precipitation. Preferred oxidizing agents are those that in their reduced form have little or no impact on the performance properties of the emulsions in which they are incorporated. Strong oxidizing agents noted above to be useful in oxidizing cationic starch, such as hypochlorite ($ClO^-$) or periodate ($IO_4^-$), are specifically contemplated. Specifically preferred oxidizing agents are halogen—e.g., bromine ($Br_2$) or iodine ($I_2$). When bromine or iodine is used as an oxidizing agent, the bromine or iodine is reduced to $Br^-$ or $I^-$. These halide ions can remain with other excess halide ions in the dispersing medium of the emulsion or be incorporated within the grains without adversely influencing photographic performance. Any level of oxidizing agent can be utilized that is effective in reducing minimum density. Concentrations of oxidizing agent added to the emulsion as low as about $1\times10^{-6}$ mole per Ag mole are contemplated. Since very low levels of Ag° are responsible for increases in minimum density, no useful purpose is served by employing oxidizing agent concentrations of greater than 0.1 mole per Ag mole. A specifically preferred oxidizing agent range is from $1\times10^{-4}$ to $1\times10^{-2}$ mole per Ag mole. The silver basis is the total silver at the conclusion of precipitation of the high bromide {111} tabular grain emulsion, regardless of whether the oxidizing agent is added during or after precipitation.

The dye image forming layer unit which contains the fragmentable electron donating compound also contains one or more one-equivalent image dye-forming couplers. As herein employed, the term "coupler" is employed in its art recognized sense of denoting a compound that reacts with a quinonediimine derived from an oxidized p-phenylenediamine color developing agent during photographic element development to perform a photographically useful function. A one equivalent image dye-forming coupler can be viewed as a two or four equivalent image dye-forming coupler modified to contain a leaving group that (a) provides the activation for coupling of leaving groups found in two equivalent image dye-forming couplers and (b) contains a dye chromophore capable of contributing to dye image density. In other words, one equivalent image dye-forming couplers can be viewed as being made up of conventional coupling moieties (COUP) of the type found in image dye-forming couplers generally and leaving moieties (LG) that are specifically selected to impart one equivalent coupling.

The image dye-forming couplers are summarized in *Research Disclosure,* Item 38957, X. Dye image formers and modifiers, B. Image-dye-forming couplers contain coupling moieties COUP of the type found in the one equivalent image dye-forming couplers contemplated for use in the image dye forming layer units of the photographic elements of this invention. Although many varied forms of COUP moieties are known, most COUP moieties have been synthesized to facilitate formation of image dyes having their main absorption in the red, green, or blue region of the visible spectrum.

For example, couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999; and "Farbkuppler: Eine Literaturubersicht," published in Agfa Mitteilungen, Band III, pp. 156–175 (1961). In the coupler moiety COUP structures shown below, the unsatisfied bond indicates the coupling position to which the leaving moiety LG is attached.

Preferably such cyan dye-forming couplers are phenols and naphthols which form cyan dyes on reaction with oxidized color developing agent at the coupling position, i.e. the carbon atom in the 4-position of the phenol or naphthol. Preferred COUP moieties of the type found in cyan dye-forming couplers are:

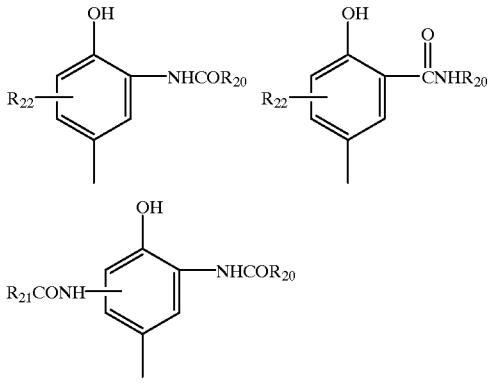

-continued

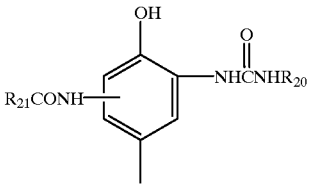

and

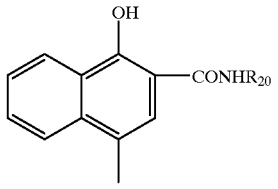

wherein $R^{20}$ and $R^{21}$ can represent a ballast group or a substituted or unsubstituted alkyl or aryl group, and $R^{22}$ represents one or more halogen (e.g. chloro, fluoro), alkyl having from 1 to 4 carbon atoms or alkoxy having from 1 to 4 carbon atoms.

Couplers which form magenta dyes upon reaction with oxidized color developing agent are described in such representative patents and publications as: U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; and "Farbkuppler: Eine Literaturubersicht," published in Agfa Mitteilungen, Band III, pp. 126–156 (1961).

Preferably such magenta dye-forming couplers are pyrazolones and pyrazolotriazoles which form magenta dyes upon reaction with oxidized color developing agents at the coupling position—i.e., the carbon atom in the 4-position for pyrazolones and the 7-position for pyrazolotriazoles. Preferred COUP moieties of the type found in magenta dye-forming couplers are:

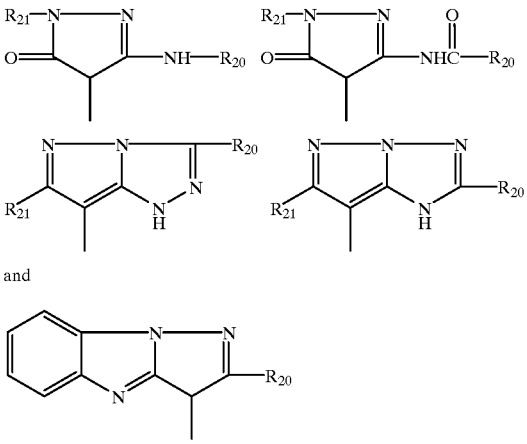

wherein $R^{20}$ and $R^{21}$ are as defined above. $R^{21}$ for pyrazolone structures is typically phenyl or substituted phenyl, such as, for example, 2,4,6-trihalophenyl, and for the pyrazolotriazole structures $R^{21}$ is typically alkyl or aryl.

Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler: Eine Literaturubersicht," published in Agfa Mitteilungen, Band III, pp. 112–126 (1961).

Preferably such yellow dye-forming couplers are acylacetamides, such as benzoylacetanilides and pivalylacetanilides. These couplers react with oxidized developer at the coupling position—i.e., the active methylene carbon atom. Preferred COUP moieties of the type found in yellow dye-forming couplers are:

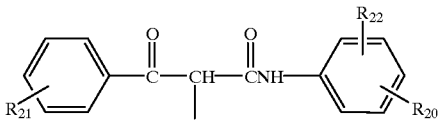

and

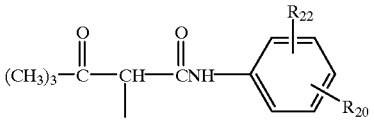

wherein $R^{20}$ and $R^{21}$ are as defined above and can also be hydrogen, alkoxy, alkoxycarbonyl, alkanesulfonyl, arenesulfonyl, aryloxycarbonyl, carbonamido, carbamoyl, sulfonamido, or sulfamoyl, and $R^{22}$ is hydrogen or one or more halogen, lower alkyl (e.g. methyl, ethyl), lower alkoxy (e.g., methoxy, ethoxy), or a ballast (e.g. alkoxy of 16 to 20 carbon atoms) group.

Other preferred COUP moieties of the type found in yellow dye-forming couplers are of the formula:

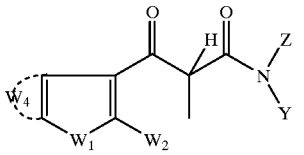

or

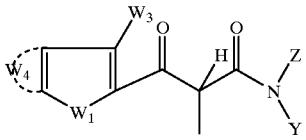

wherein:

$W_1$ is a heteroatom or heterogroup, preferably —NR-, —O—, —S—, —$SO_2$—;

$W_2$ is H, or a substituent group, such as an alkyl or aryl group;

$W_3$ is H, or a substituent group, such as an alkyl or aryl group;

$W_4$ represents the atoms necessary to form a fused ring with the ring containing $W_1$, preferably a benzo group;

Y and Z are independently H or a substituent group, preferably Y is H and Z is a substituted phenyl group.

Other preferred COUP moieties of the type found in yellow dye-forming couplers are of the formula:

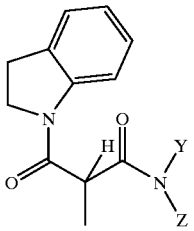

or

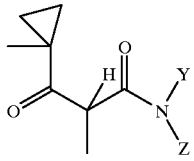

wherein Y and Z are as defined above.

The leaving group LG differs from the leaving groups of two equivalent image dye-forming couplers in that LG itself contains a dye chromophore. If the dye chromophore of LG exhibits the same hue before and after separation from COUP, it does not contribute to forming a dye image, but simply increases dye density uniformly in all image areas. To obtain a desired image dye light absorption when LG is released from COUP while avoiding unwanted light absorption by the dye chromophore in LG when LG remains attached to COUP, conventional LG constructions are chosen to produce a bathochromic shift of light absorption in released LG as compared to COUP attached LG. For example, assuming that a yellow (blue light absorbing) dye image is sought, LG can be constructed to contain an ultraviolet absorbing dye chromophore when attached to COUP, and release from COUP can result in shifting absorption bathochromically into the blue region of the spectrum, thereby changing the perceived hue of the LG incorporated dye from essentially colorless to yellow. With LG constructions permitting longer wavelength bathochromic shifts, the LG hue can shift from essentially colorless (UV absorbing) to green or even red. For green and red absorbing dyes in released LG, it is recognized that initial (COUP attached) LG absorption may, depending upon the construction chosen, extend into the visible region of the spectrum. This initially visible absorption is lost when LG is released. The loss of light absorption in a selected region of the visible spectrum as a result of a coupling reaction is a property also exhibited by conventional masking couplers, commonly used in color negative films for color correction. Thus, it is possible to choose the initial absorption of LG as attached to COUP so that the absorption shift on release performs the function of a masking coupler.

LG can take the form of any conventional one equivalent coupler leaving group. One equivalent couplers having leaving groups suitable for use in the image forming layer units of the photographic elements of the invention are described in Lau U.S. Pat. No. 4,248,962 and Mooberry et al U.S. Pat. Nos. 4,840,884, 5,447,819 and 5,457,004, the disclosures of which are here incorporated by reference. The one equivalent image dye-forming couplers of Mooberry et al are preferred, since they do not require mordanting on release to retain their desired hue. Viewed another way, the Mooberry et al one equivalent image dye-forming couplers can contain release dyes that are charge neutral.

Preferred one equivalent image dye-forming couplers include the following components:

$$COUP\text{-}L'_n\text{—}B'\text{—}N(R_{23})\text{-}DYE$$

wherein:

COUP is the coupler moiety;

DYE is an image dye or image dye precursor;

$L'_n$—B' is a group that is at least divalent;

B' is —OC(O)—, —OC(S)—, —SC(O)—, —SC(S)— or —OC(=$NSO_2R_{24}$)-, where $R_{24}$ is a substituted or unsubstituted all or aryl group;

L' is a linking group;

$R_{23}$ is a substituent; and n is zero or 1.

The COUP bond and the B'—N($R_{23}$) bond are both cleaved under conditions permitting coupling off to occur. Cleaving the B'—N($R_{23}$) bond bathochromically shifts the hue of the DYE.

DYE can include an auxochrome associated with the dye, where an auxochrome is a group that increases dye absorption intensity.

B' in the form of —OC(=$NSO_2R_{24}$)- and —OC(O)—, particularly the latter, is preferred to maintain the lowest possible densities in unexposed areas.

N($R_{23}$) either forms a part of the auxochrome or chromophore of DYE. Illustrative groups in which —N($R_{23}$)- forms a part of an auxochrome are as follows:

The nitrogen atom in —$NR_{23}$- is optionally located in an auxochrome, that is a group that intensifies the color of the dye, or it is optionally an integral part of the dye chromophore.

Illustrative groups wherein —$NR_{23}$- is part of auxochrome are as follows:

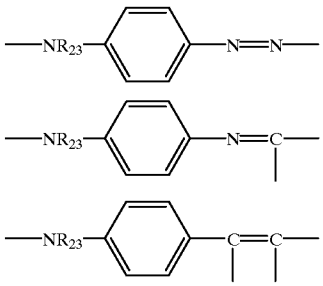

Illustrative groups in which —N($R_{23}$)- forms a part of a dye chromophore are as follows:

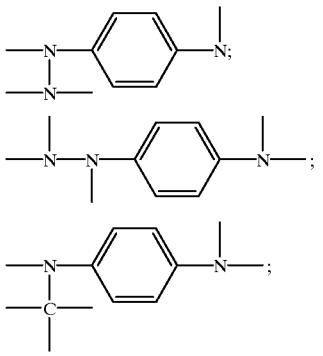

-continued

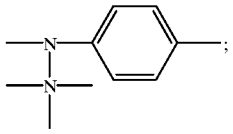

The particular group $L'_n$—B' can be varied to help control such parameters as rate and time of release of the —$NR_{23}$-DYE group. The particular group $L'_n$—B' employed, including the nature of the substituents on $L'_n$—B', can additionally control the rate and distance of diffusion of the unit formed by the group $L'_n$—B', the —$NR_{23}$- group and the DYE after this unit is released from the coupler moiety but before the —$NR_{23}$- DYE is released. The group $L'_n$—B' preferably causes a spectral shift in absorption of DYE as a function of attachment to —$NR_{23}$-. Also, the group $L'_n$—B' preferably stabilizes the DYE to oxidation, particularly wherein the —$NR_{23}$- is part of the chromophore.

The coupler moiety COUP can be any moiety which will react with oxidized color developing agent to cleave the bond between the $L'_n$—B' group and the coupler moiety. It includes coupler moieties employed in conventional color-forming couplers which yield colorless products on reaction with oxidized color developing agents as well as coupler moieties which yield colored products on reaction with oxidized color developing agents. Both types of coupler moieties are well known to those skilled in the art.

The coupler moiety can be unballasted or ballasted with an oil-soluble or fat-tail group. It can be monomeric, or it can form part of a dimeric, oligomeric or polymeric coupler, in which case more than one -$L'_n$—B'—$NR_{23}$- DYE unit can be contained in the coupler.

It will be appreciated that, depending upon the particular coupler moiety, the particular color developing agent and the type of processing, the reaction-product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless.

The -$L'_n$—B'—$NR_{23}$- DYE unit is joined to the coupler moiety at any of the positions from which groups released from couplers by reaction with oxidized color developing agent can be attached. The -$L'_n$—B'—$NR_{23}$- DYE unit is attached at the coupling position of the coupler moiety so that upon reaction of the coupler with oxidized color developing agent the -$L'_n$—B'—$NR_{23}$- DYE will be displaced.

The group $L'_n$—B' can be any organic group which will serve to connect COUP to the —$NR_{23}$- group and which, after cleavage from COUP will cleave from the —$NR_{23}$- group, for example by an elimination reaction of the type described in, for example, U.S. Pat. No. 4,409,323. The elimination reaction involves electron transfer down a conjugated chain. As used herein the term "electron transfer down a conjugated chain" is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

The group $L'_n$—B' can contain moieties and substituents which will permit control of one or more of the following rates: (i) the rate of reaction of COUP with oxidized color developing agent, (ii) the rate of diffusion of -$L'_n$—B'—

$NR_{23}$- DYE and (iii) the rate of release of DYE. The group $L'_n$—B' can contain additional substituents or precursors thereof which may remain attached to the group or be released.

Illustrative $L'_n$—B' groups include:

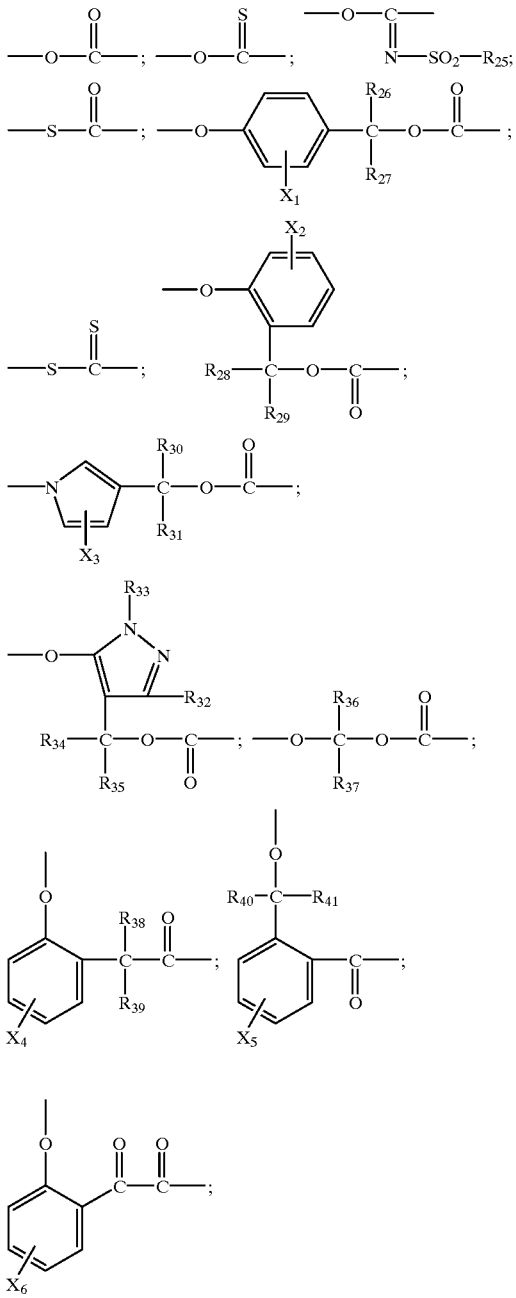

wherein $X_1$ through $X_6$ and $R_{23}$ through $R_{41}$ are substituents that do not adversely affect the described COUP-$L'_n$—B'—$NR_{23}$- DYE. For example, $R_{23}$ through $R_{41}$ are individually hydrogen, unsubstituted or substituted alkyl, such as alkyl containing 1 to 30 carbon atoms, for example, methyl, ethyl, propyl, n-butyl, t-butyl, pentyl and eicosyl; or cycloalkyl, such as cyclopentyl, cyclohexyl and 4-methoxycyclohexyl; or aryl, such as unsubstituted or substituted phenyl. $X_1$ through $X_6$ can be hydrogen or a substituent that does not adversely affect the described COUP-$L'_n$—B'—$NR_{23}$- DYE, such as electron withdrawing or donating groups, for example, alkyl, such as methyl, ethyl, propyl, n-butyl, t-butyl and eicosyl, halogen, such as chlorine and bromine, nitro, carbamyl, acylamido, sulfonamido, sulfamyl, sulfo, carboxyl, cyano, and alkoxy, such as methoxy and ethoxy, acyl, sulfonyl, hydroxy, alkoxycarbonyl, and aryloxy. The group $L'_n$—B' can be, for example, a linking group within U.S. Pat. No 4,409,323 or a nucleophilic displacement type linking group as described in, for example, U.S. Pat. No. 4,248,962, or a linking group which is a combination of these two types.

A particularly useful $L'_n$—B' group is.

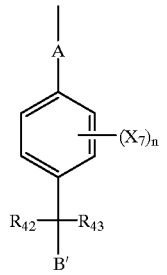

wherein A is O, S, or sulfonamido (N—$SO_2$ $R_{44}$);

B' is as previously defined;

$R_{42}$ and $R_{43}$ are individually hydrogen, or substituted or unsubstituted alkyl, such as methyl, ethyl, propyl, n-butyl or t-butyl, or aryl, such as unsubstituted or substituted phenyl;

$X_7$ is a substituent as described for $X_1$, that does not adversely affect the coupler; and n is 0, 1, 2, 3 or 4. $R_{44}$ is a substituent, typically alkyl or aryl. Typically $R_2$ and 3 are hydrogen.

Typically $R_{42}$ and $R_{43}$ are hydrogen.

Preferred $L'_n$—B' linking groups include:

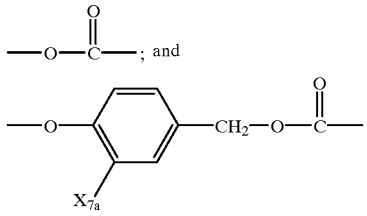

wherein $X_{7a}$ is hydrogen, chlorine, methylsulfonamido ($NHSO_2$ $CH_3$), —$COOCH_3$, —$NHCOCH_3$, —$CONHCH_3$, —$COHNCH_2$ COOH, —COOH or $CON(CH_3)_2$.

A particularly useful linking group is represented by the formula:

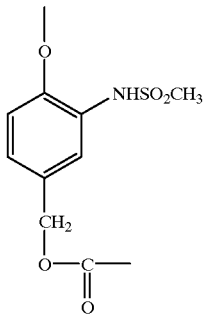

The linking group and DYE optionally contain substituents that can modify the rate of reaction, diffusion, or displacement, such as halogen, including fluoro, chloro, bromo, or iodo, nitro, alkyl of 1 to 20 carbon atoms, acyl, carboxy, carboxyalkyl, alkoxycarbonyl, alkoxycarbonamido, alkylcarbamyl, sulfoalkyl, alkylsulfonamido, and alkylsulfonyl, solubilizing groups, ballast groups and the like. For example, solubilizing groups will increase the rate of diffusion and ballast groups will decrease the rate of diffusion.

The $R_{23}$ substituent on —$NR_{23}$- can be any substituent that does not adversely affect the coupler (A). When the —$NR_{23}$- is part of an auxochrome, $R_{23}$ can be, for example, hydrogen or alkyl, such as alkyl containing 1 to 30 carbon atoms, including methyl, ethyl, propyl, n-butyl, t-butyl or eicosyl, or aryl, such as phenyl. When the nitrogen atom attached to $L'_n$—B' is part of a chromophore, $R_{23}$ becomes an integral part of the chromophore.

Preferred $R_{23}$ groups are alkyl, such as alkyl containing 1 to 18 carbon atoms when $R_{23}$ is part of the dye auxochrome. $R_{23}$ when part of the chromophore is, for example, unsubstituted or substituted aryl, such as phenyl.

The DYE as described includes any releasable, electrically neutral dye that enables dye hue stabilization without mordanting the dye formed. The release mechanism can be initiated by oxidized reducing agent.

The particular DYE and the nature of the substituents on the DYE can control whether or not the dye diffuses and the rate and distance of diffusion of the DYE formed. For example, the DYE can contain a ballast group known in the photographic art that hinders or prevents diffusion. The DYE can contain a water solubilizing group, such as carboxy or sulfonamide groups, to help diffusion of the DYE. Such groups are known to those skilled in the art.

Particularly usefull classes of DYE moieties are:

I. Azo dye moieties including the —$NR_{23}$- group represented by the structure:

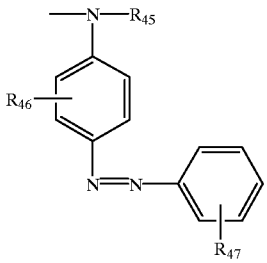

wherein $R_{45}$, $R_{46}$ and $R_{47}$ are individually hydrogen or a substituent, such as alkyl. The aromatic rings containing $R_{46}$ and $R_{47}$ may also be heteroaromatic rings containing one or more ring N atoms.

II. Azamethine dye moieties including the —$NR_{23}$- group represented by the structure:

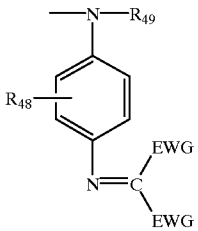

wherein $R_{48}$ is hydrogen or a substituent, such as alkyl; $R_{49}$ is hydrogen or a substituent, such as alkyl; and EWG is an electron withdrawing group.

III. Methine dye moieties including the —$NR_{23}$- group represented by the structure:

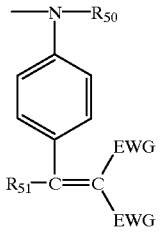

wherein $R_{50}$ is hydrogen or a substituent, such as alkyl; $R_{51}$ is hydrogen or a substituent such as alkyl; and EWG is an electron withdrawing group.

The term DYE also includes dye precursors wherein the described substituted nitrogen atom is an integral part of the chromophore, also described herein as leuco dye moieties. Such dye precursors include, for example:

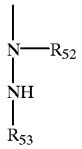

wherein $R_{52}$ and $R_{53}$ are aryl, such as substituted phenyl.

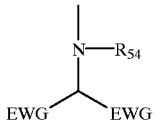

wherein $R_{54}$ is an aryl group, such as substituted phenyl; and EWG is an electron withdrawing group.

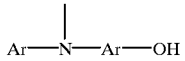

wherein Ar are individually substituted aryl groups, particularly substituted phenyl groups. When the DYE moiety is a leuco dye, $L'_n$—B' preferably comprises a timing group that enables delay of oxidation of the leuco dye by silver halide in a photographic silver halide element. For example, it is preferred that $L'_n$—B' be a

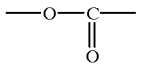

group when DYE is a leuco dye moiety as described.

Examples of cyan, magenta, yellow and leuco dyes are as follows:

A. Cyan

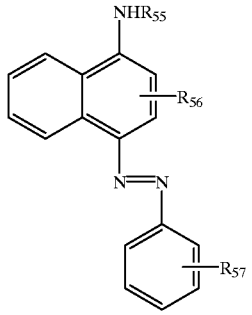

wherein $R_{55}$ is a substituent that does not adversely affect the dye, such as alkyl; $R_{56}$ is a substituent, such as an electron releasing group; and $R_{57}$ is a substituent, such as a strong electron withdrawing group.

B. Magenta

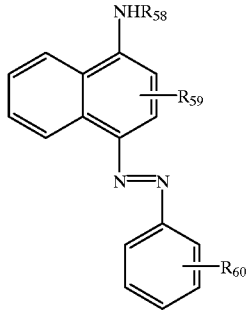

wherein $R_{58}$ is a substituent that does not adversely affect the dye, such as alkyl; $R_{59}$ is a substituent, such as an electron releasing group; and $R_{60}$ is a substituent, such as a strong electron withdrawing group.

C. Yellow

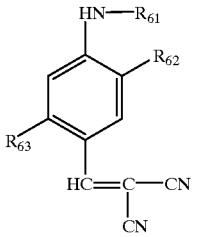

wherein $R_{61}$ is alkyl; $R_{62}$ is alkoxy; and $R_{63}$ is alkyl; and

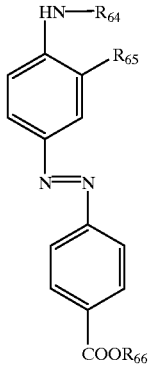

wherein $R_{64}$ is alkyl; $R_{65}$ is alkoxy; and $R_{66}$ is alkyl or aryl.

D. Leuco

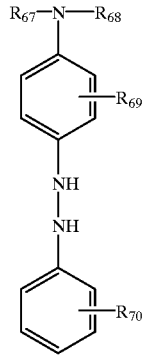

wherein $R_{67}$ and $R_{68}$ are individually hydrogen or alkyl; $R_{69}$ is an electron releasing group; and $R_{70}$ is a strong electron withdrawing group.

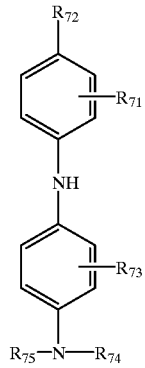

wherein $R_{71}$ and $R_{73}$ are individually hydrogen or a substituent; $R_{72}$ is a hydroxyl, $NHR_{76}$ or NHSO2 $R_{76}$ wherein $R_{76}$ is a substituent; $R_{74}$ and $R_{75}$ are individually hydrogen or a substituent.

The following are specific illustrations of one equivalent image dye-forming couplers contemplated for use in the practice of this invention:

OEC-1

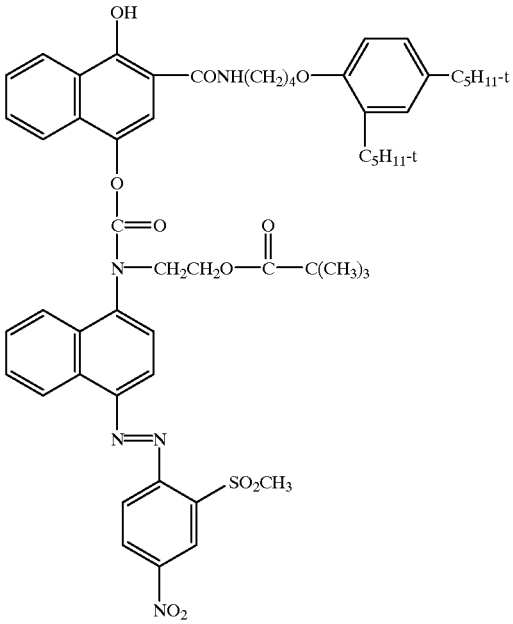

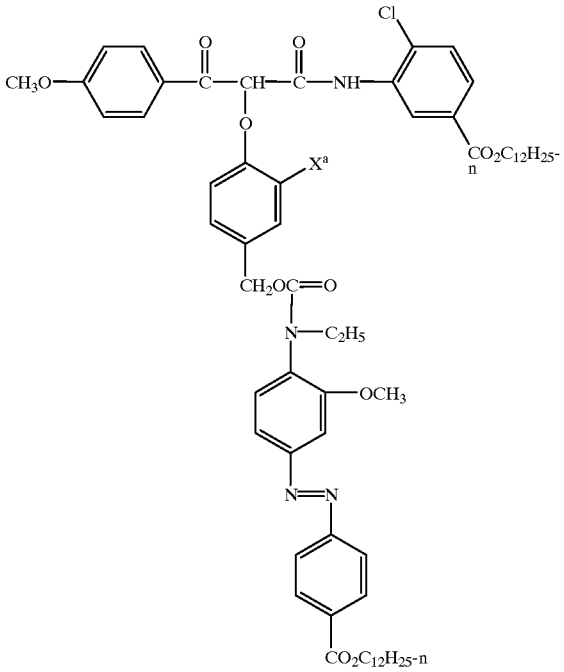

OEC-2

$X^a$═NHCOCH$_3$

OEC-3

$X^a$═NHSO$_2$CH$_3$

-continued

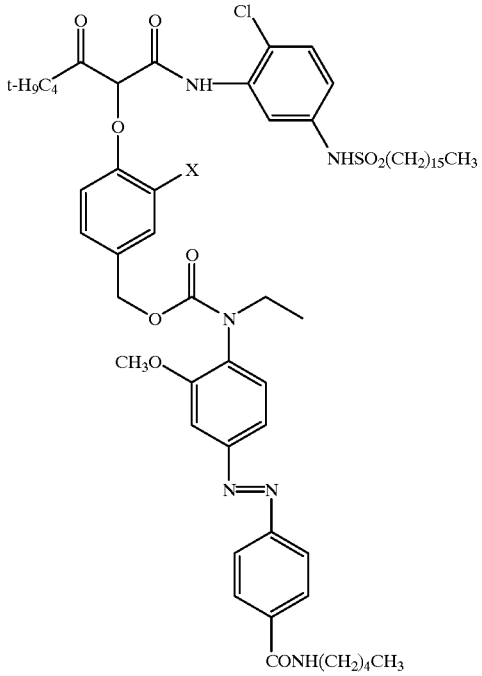

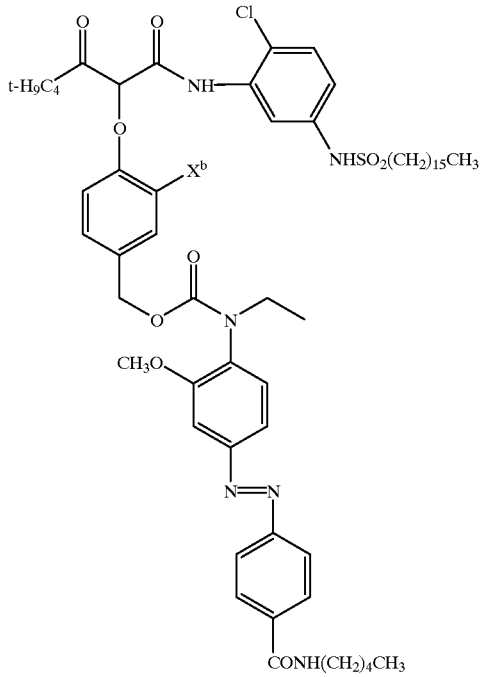

OEC-4

X = —NHSO$_2$—⟨benzene⟩—NHSO$_2$CH$_3$ $X^b$ = —NHSO$_2$—⟨benzene⟩—NHSO$_2$CH$_3$

OEC-5

X = —NHCO—⟨benzene⟩—NHSO$_2$CF$_3$

-continued
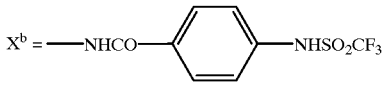
OEC-6
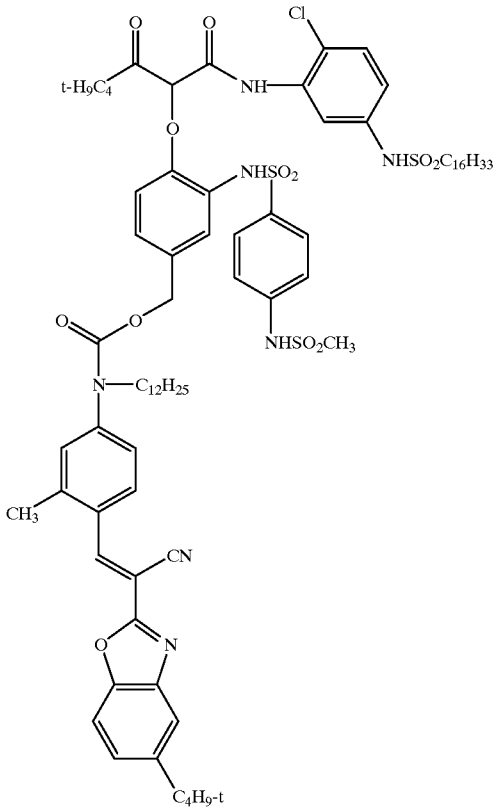
OEC-7
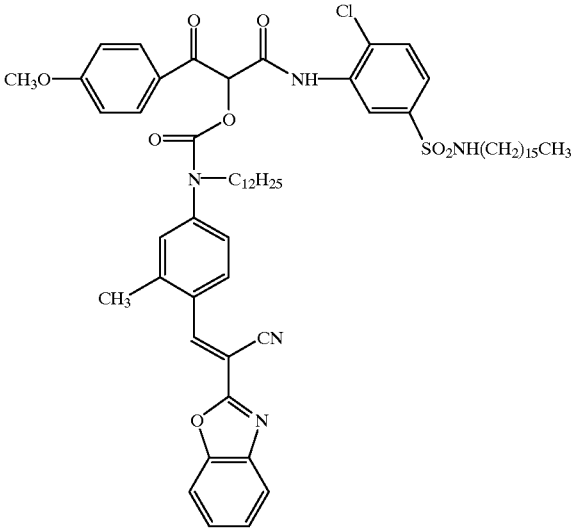
-continued
OEC-8
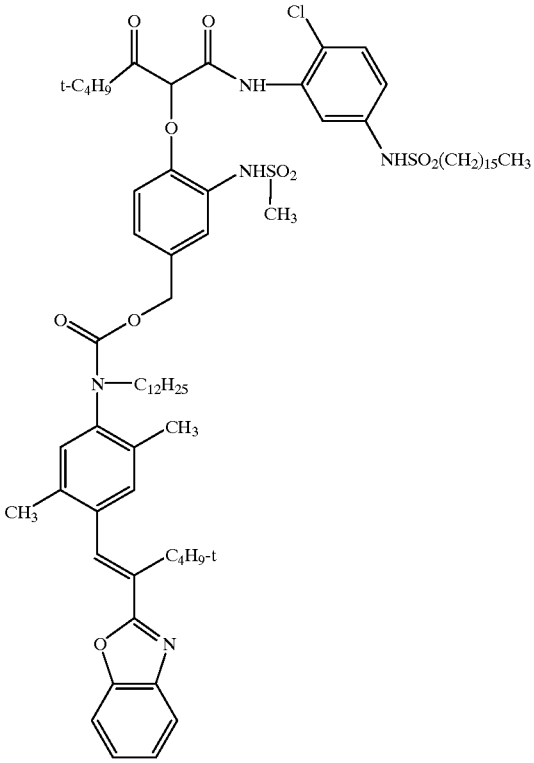
OEC-9
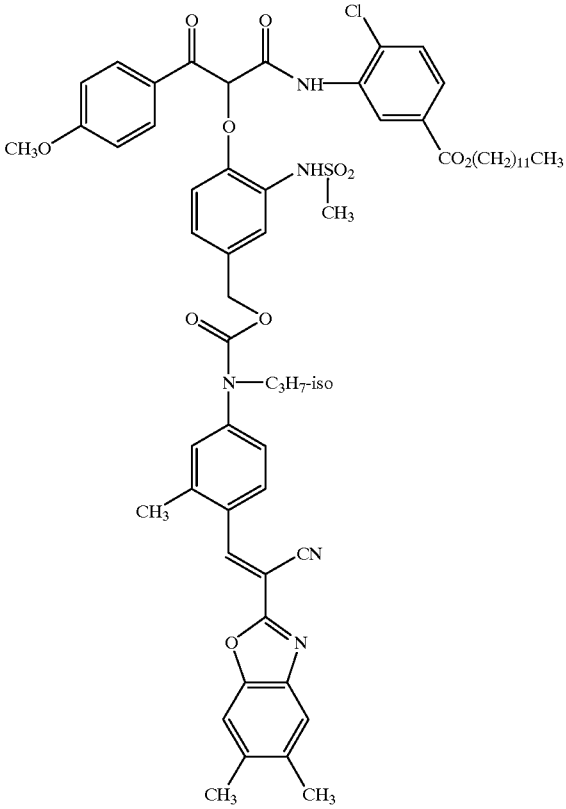

-continued

OEC-10

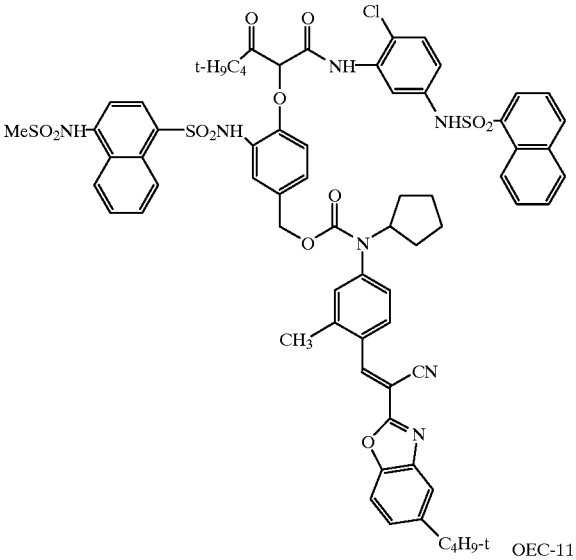

OEC-11

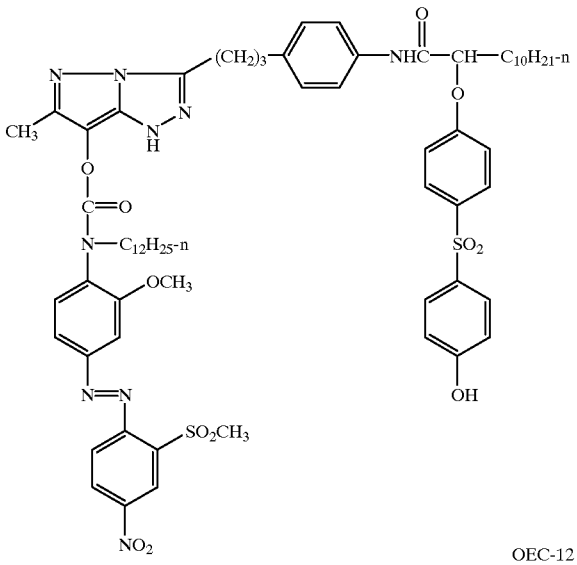

OEC-12

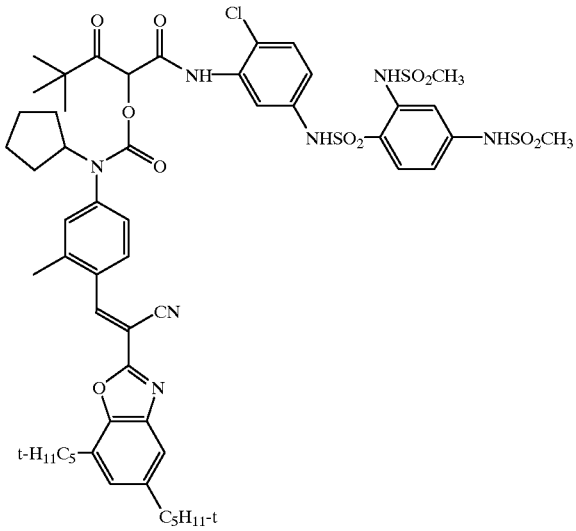

In addition to one equivalent image dye-forming coupler the image forming layer unit can, if desired, contain one or more other conventional couplers. For example, it is contemplated to employ one or more four equivalent or, particularly, two equivalent image dye-forming couplers in combination with an image dye-forming one equivalent coupler. When image dye-forming couplers are used in combination, it is preferred that at least 20 percent on a mole basis of image dye-forming coupler present be provided by one or more one equivalent image dye-forming couplers.

Other couplers that can be present in the photographic element of the invention include, for example:

Couplers which combine with oxidized developer to produce cyan colored dyes are shown, for example, in Weissberger et al U.S. Pat. No. 2,474,293, Vittum et al U.S. Pat. No. 3,002,836, Stecker U.S. Pat. No. 3,041,236, Ono et al U.S. Pat. No. 4,746,602, Kilminster U.S. Pat. No. 4,753,871, Aoki et al U.S. Pat. No. 4,770,988, Kilminster et al U.S. Pat. No. 4,775,616, Hamada et al U.S. Pat. No. 4,818,667, Masukawa et al U.S. Pat. No. 4,818,672, Monbaliu et al U.S. Pat. No. 4,822,729, Monbaliu et al U.S. Pat. No. 4,839,267, Masukawa et al U.S. Pat. No. 4,840,883, Hoke et al U.S. Pat. No. 4,849,328, Miura et al U.S. Pat. No. 4,865,961, Tachibana et al U.S. Pat. No. 4,873,183, Shimada et al U.S. Pat. No. 4,883,746, Tani et al U.S. Pat. No. 4,900,656, Ono et al U.S. Pat. No. 4,904,575, Tachibana et al U.S. Pat. No. 4,916,05 1, Nakayama et al U.S. Pat. No. 4,921,783, Merkel et al U.S. Pat. No. 4,923,791, Tachibaba et al U.S. Pat. No. 4,950,585, Aoki et al U.S. Pat. No. 4,971,898, Lau U.S. Pat. No. 4,990,436, Masukawa et al U.S. Pat. No. 4,996,139, Merkel U.S. Pat. No. 5,008,180, Wolff U.S. Pat. No. 5,015,565, Tachibana et al U.S. Pat. No. 5,011,765, Kida et al U.S. Pat. No. 5,011,766, Masukawa et al U.S. Pat. No. 5,017,467, Hoke U.S. Pat. No. 5,045,442, Uchida et al U.S. Pat. No. 5,051,347, Kaneko U.S. Pat. No. 5,061,613, Kita et al U.S. Pat. No. 5,071,737, Langen et al U.S. Pat. No. 5,075,207, Fukunada et al U.S. Pat. No. 5,091,297, Tsukahara et al U.S. Pat. 5,094,938, Shimada et al U.S. Pat. No. 5,104,783, Fujita et al U.S. Pat. No. 5,178,993, Naito et al U.S. Pat. No. 5,813,729, Ikesu et al U.S. Pat. No. 5,187,057, Tsukahara et al U.S. Pat. No. 5,192,651, Schumann et al U.S. Pat. No. 5,200,305, Yamakawa et al U.S. Pat. No. 5,202,224, Shimada et al U.S. Pat. No. 5,206,130, Ikesu et al U.S. Pat. No. 5,208,141, Tsukahara et al U.S. Pat. No. 5,210,011, Sato et al U.S. Pat. No. 5,215,871, Kita et al U.S. Pat. No. 5,223,386, Sato et al U.S. Pat. No. 5,227,287, Suzuki et al U.S. Pat. No. 5,256,526, Kobayashi et al U.S. Pat. No. 5,258,270, Shimada et al U.S. Pat. No. 5,272,051, Ikesu et al U.S. Pat. No. 5,306,610, Yamakawa U.S. Pat. No. 5,326,682,Shimada et al U.S. Pat. No. 5,366,856, Naruse et al U.S. Pat. No. 5,378,596, Takizawa et al U.S. Pat. No. 5,380,638, Lau et al U.S. Pat. No. 5,382,502, Matsuoka et al U.S. Pat. No. 5,384,236, Takada et al U.S. Pat. No. 5,397,691, Kaneko et al U.S. Pat. No. 5,415,990, Asami U.S. Pat. No. 5,434,034, Tang et al U.S. Pat. No. 5,441,863, Tashiro et al EPO 0 246 616, Lau EPO 0 250 201, Kilminster et al EPO 0 271 323, Sakanoue et al EPO 0 295 632, Mihayashi et al EPO 0 307 927, Ono et al EPO 0 333 185, Shinba et al EPO 0 378 898, Giusto EPO 0 389 817, Sato et al EPO 0 487 111, Suzuki et al EPO 0 488 248, Ikesu et al EPO 0 539 034, Suzuki et al EPO 0 545 300, Yamakawa et al EPO 0 556 700, Shimada et al EPO 0 556 777, Kawai EPO 0 556 858, Yoshioka EPO 0 569 979, Ikesu et al EPO 0 608 133, Merkel et al EPO 0 636 936, Merkel et al EO 0 651 286, Sugita et al EPO 0 690 344, Renner et al German OLS 4,026,903, Langen et al German OLS 3,624,777 and Wolff et al German OLS 3,823,049;

Magenta coupler types are shown, for example, in Porter et al U.S. Pat. Nos. 2,311,082 and 2,369,489, Tuite U.S. Pat. No. 3,152,896, Arai et al U.S. Pat. No. 3,935,015, Renner U.S. Pat. No. 4,745,052, Ogawa et al U.S. Pat. No. 4,762,775, Kida et al U.S. Pat. No. 4,791,052, Wolff et al U.S. Pat. No. 4,812,576, Wolff et al U.S. Pat. No. 4,835,094, Abe et al U.S. Pat. No. 4,840,877, Wolff U.S. Pat. No. 4,845,022, Krishnamurthy et al U.S. Pat. No. 4,853,319, Renner U.S. Pat. No. 4,868,099, Helling et al U.S. Pat. No. 4,865,960, Normandin U.S. Pat. No. 4,871,652, Buckland U.S. Pat. No. 4,876,182, Bowne et al U.S. Pat. No. 4,892,805, Crawley et al U.S. Pat. No. 4,900,657, Furutachi U.S. Pat. No. 4,910,124, Ikesu et al U.S. Pat. No. 4,914,013, Yokoyama et al U.S. Pat. No. 4,921,968, Furutachi et al U.S. Pat. No. 4,929,540, Kim et al U.S. Pat. No. 4,933,465, Renner U.S. Pat. No. 4,942,116, Normandin et al U.S. Pat. No. 4,942,117, Nonnandin et al U.S. Pat. No. 4,942 118, Normandin et al U.S. Pat. No. 4,959,480, Shimazaki et al U.S. Pat. No. 4,968,594, Ishige et al U.S. Pat. No. 4,988,614, Bowne et al U.S. Pat. No. 4,992,361, Renner et al U.S. Pat. No. 5,002,864, Bumns et al U.S. Pat. No. 5,021,325, Sato et al U.S. Pat. No. 5,066,575, Morigaki et al U.S. Pat. No. 5,068,171, Ohya et al U.S. Pat. No. 5,071,739, Chen et al U.S. Pat. No. 5,100,772, Harder et al U.S. Pat. No. 5,110,942, Kimura et al U.S. Pat. No. 5,116,990, Yokoyama et al U.S. Pat. No. 5,118,812, Kunitz et al U.S. Pat. No. 5,134,059, Mizukawa et al U.S. Pat. No. 5,155,016, Romanet et al U.S. Pat. No. 5,183,728, Tang et al U.S. Pat. No. 5,234,805, Sato et al U.S. Pat. No. 5,235,058, Krishnamurthy et al U.S. Pat. No. 5,250,400, Ikenoue et al U.S. Pat. No. 5,254,446, Krishnamurthy et al U.S. Pat. No. 5,262,292, Matsuoka et al U.S. Pat. No. 5,300,407, Romanet et al U.S. Pat. No. 5,302,496, Daifuku et al U.S. Pat. No. 5,336,593, Singer et al U.S. Pat. No. 5,350,667, Tang U.S. Pat. No. 5,395,968, Helling et al U.S. Pat. No. 5,354,826, Tang et al U.S. Pat. No. 5,358,829, Ishidai et al U.S. Pat. No. 5,368,998, Krishnamurthy et al U.S. Pat. No. 5,378,587, Mizukawa et al U.S. Pat. No. 5,409,808, Signer et al U.S. Pat. No. 5,411,841, Wolff U.S. Pat. No. 5,418,123, Tang U.S. Pat. No. 5,424,179, Numata et al EPO 0 257 854, Bowne et al EPO 0 284 240, Webb et al EPO 0 341 204, Miura et al EPO 347,235, Yukio et al EPO 365,252, Yamazaki et al EPO 0 422 595, Kei EPO 0 428 899, Tadahisa et al EPO 0 428 902, Hieechi et al EPO 0 459 331, Sakanoue et al EPO 0 467 327, Kida et al, EPO 0 476 949, Kei et al, EPO 0 487 081, Wolfe EPO 0 489 333, Coraluppi et al EPO 0 512 304, Hirabayashi et al EPO 0 515 128, Harabayashi et al EPO 0 534 703, Sato et al EPO 0 554 778, Tang et al EPO 0 558 145, Mizukawa et al EPO 0 571 959, Schofield et al EPO 0 583 832, Schofield et al EPO 0 583 834, Hirabayashi et al EPO 0 584 793, Tang et al EPO 0 602 748, Tang et al EPO 0 602 749, Lau et al EPO 0 605 918, Allway EPO 0 622 672, Allway EPO 0 622 673, Kita et al EPO 0 629 912, Kapp et al EPO 0 646 841,Kita et al EPO 0 656 561, Ishidai et al EPO 0 660 177, Tanaka et al EPO 0 686 872, Thomas et al WO 90/10253, Williamson et al WO 92/09010, Leyshon et al, WO 92/10788, Crawley et al WO 92/12464, Williamson WO 93/01523, Merkel et al WO 93/02392, Krishnamurthy et al WO 93/02393, Williamson WO 93/07534, UK Patent Application 2,244,053, Japanese Patent Application 03192-350, Renner German OLS 3,624,103, Wolff et al German OLS 3,912,265, and Werner et al German OLS 40 08 067; and Compounds useful for forming yellow colored dyes upon coupling with oxidized color developer include, for example, Weissberger U.S. Pat. No. 2,298,443, Okumura et al U.S. Pat. No. 4,022,620, Buckland et al U.S. Pat. No. 4,758,501, Ogawa et al U.S. Pat. No. 4,791,050, Buckland et al U.S. Pat. No. 4,824,771, Sato et al U.S. Pat. No. 4,824,773, Renner et al U.S. Pat. No. 4,855,222, Tsoi U.S. Pat. No. 4,978,605, Tsuruta et al U.S. Pat. No. 4,992,360, Tomotake et al U.S. Pat. No. 4,994,361, Leyshon et al U.S. Pat. No. 5,021,333, Masukawa U.S. Patent 5,053,325, Kubota et al U.S. Pat. No. 5,066,574, Ichijima et al U.S. Pat. No. 5,066,576, Tomotake et al U.S. Pat. No. 5,100,773, Lau et al U.S. Pat. No. 5,118,599, Kunitz U.S. Pat. No. 5,143,823, Kobayashi et al U.S. Pat. No. 5,187,055, Crawley U.S. Pat. No. 5,190,848, Motoki et al U.S. Pat. No. 5,213,958, Tomotake et al U.S. Pat. No. 5,215,877, Tsoi U.S. Pat. No. 5,215,878, Hayashi U.S. Pat. No. 5,217,857, Takada et al U.S. Pat. No. 5,219,716, Ichijima et al U.S. Pat. No. 5,238,803,Kobayashi et al U.S. Pat. No. 5,283,166, Kobayashi et al U.S. Pat. No. 5,294,531,Mihayashi et al U.S. Pat. No. 5,306,609, Fukuzawa et al U.S. Pat. No. 5,328,818, Yamamoto et al U.S. Pat. No. 5,336,591, Saito et al U.S. Pat. No. 5,338,654, Tang et al U.S. Pat. No. 5,358,835, Tang et al. U.S. Pat. No. 5,358,838, Tang et al U.S. Pat. No. 5,360,713, Morigaki et al U.S. Pat. No. 5,362,617, Tosaka et al U.S. Pat. No. 5,382,506, Ling et al U.S. Pat. No. 5,389,504, Tomotake et al U.S. Pat. No. 5,399,474, Shibata U.S. Pat. No. 5,405,737, Goddard et al U.S. Pat. No. 5,411,848, Tang et al U.S. Pat. No. 5,427,898, Himmelmann et al EPO 0 327 976, Clark et al EPO 0 296 793, Okusa et al EPO 0 365 282, Tsoi EPO 0 379 309, Kida et al EPO 0 415 375, Mader et al EPO 0 437 818, Kobayashi et al EPO 0 447 969, Chino et al EPO 0 542 463, Saito et al EPO 0 568 037, Tomotake et al EPO 0 568 196, Okumura et al EPO 0 568 777 and Yamada et al EPO 0 570 006, Kawai EPO 0 573 761, Carmack et al EPO 0 608 956, Cannack et al EPO 0 608 957, Mooberry et al EPO 0 628 865.

The tabular grain silver halide emulsion containing a one-equivalent coupler and a fragmentable electron donating compound in accordance with this invention may be spectrally sensitized by the use of a spectral sensitizing dye, as is well known to one of skill in the art. Preferred sensitizing dyes that can be used are cyanine, merocyanine, styryl, hemicyanine, or complex cyanine dyes. Illustrative dyes that can be used include those dyes disclosed in U.S. Pat. Nos. 5,747,235 and 5,747,236, the entire disclosures of which are incorporated herein by reference.

The sensitization of the silver halide with the sensitizing dyes may be carried out by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

The emulsion layer of the photographic element of the invention can comprise any one or more of the light sensitive layers of the photographic element. The photographic elements made in accordance with the present invention are multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which is preferably transparent.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support).

The present invention also contemplates the use of photographic elements of the present invention in what are often referred to as single use cameras (or "film with lens" units). Single use cameras are well known and typically comprise (1) a plastic inner camera shell including a taking lens, a film metering mechanism, and a simple shutter and (2) a paper-cardboard outer sealed pack which contains the inner camera shell and has respective openings for the taking lens and for a shutter release button, a frame counter window, and a film advance thumbwheel on the camera shell. The camera may also have a flash unit to provide light when the picture is taken. The inner camera shell has front and rear viewfinder windows located at opposite ends of a see-through viewfinder tunnel, and the outer sealed pack has front and rear openings for the respective viewfinder windows. At the manufacturer, the inner camera shell is loaded with a film cartridge, and substantially the entire length of the unexposed filmstrip is factory prewound from the cartridge into a supply chamber of the camera shell. After the customer takes a picture, the thumbwheel is manually rotated to rewind the exposed frame into the cartridge. The rewinding movement of the filmstrip the equivalent of one frame rotates a metering sprocket to decrement a frame counter to its next lower numbered setting. When substantially the entire length of the filmstrip is exposed and rewound into the cartridge, the single-use camera is sent to a photofinisher who first removes the inner camera shell from the outer sealed pack and then removes the filmstrip from the camera shell. The filmstrip is processed, and the camera shell and the opened pack are thrown away or, preferably, recycled..

In the following discussion of suitable materials for use in elements of this invention, reference will be made to *Research Disclosure,* September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire PO10 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-1 13935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may firther contain other image-modifying compounds such as "Development Inhibitor-Releasing" compounds (DIR's). Useful additional DIR's for elements of the present invention, are known in the art and examples are described in U.S. Pat. No. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

Various other compounds may be added to the photographic material of the present invention for the purpose of lowering the fogging of the material during manufacture, storage, or processing. Typical antifoggants are discussed in Section VI of Research Disclosure 1, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

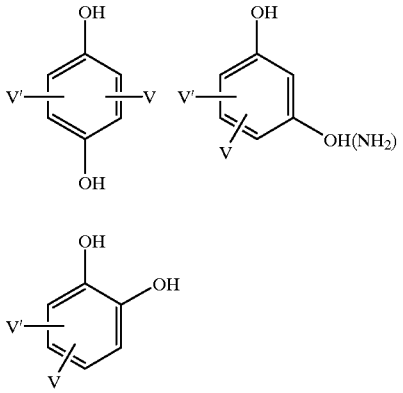

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, —$CH_2CH_2COOH$, —$CH_3$, —$CH_2CH_3$, —$C(CH_3)_3$, —$OCH_3$, —CHO, —$SO_3K$,—$SO_3Na$, —$SO_3H$, —$SCH_3$, or -phenyl.

Especially preferred hydroxybenzene compounds follow:

HB1

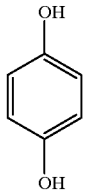

HB2

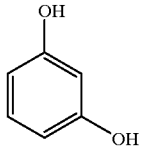

HB3

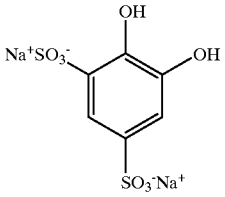

HB4

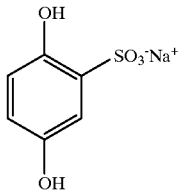

HB5

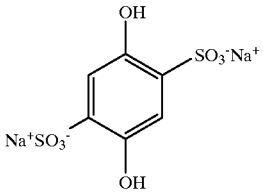

HB6

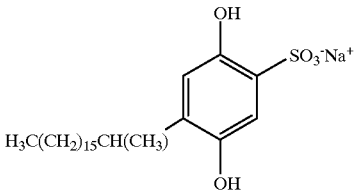

-continued

HB7

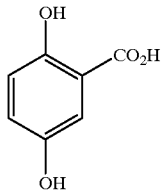

HB8

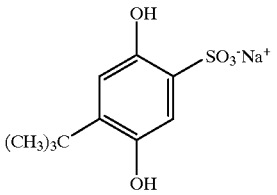

HB9

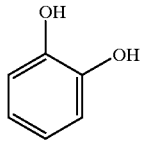

HB10

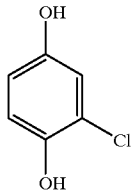

HB11

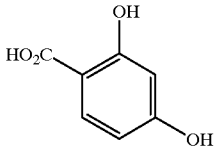

HB12

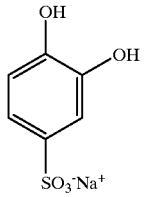

HB13

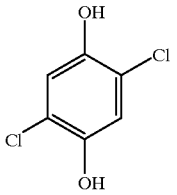

HB14

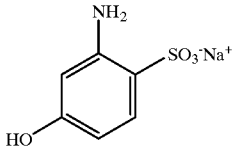

-continued

HB15

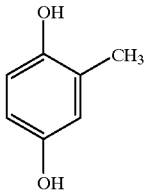

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl- N-ethyl- N-(β-(methanesulfonamido) ethylaniline sesquisulfate hydrate, 4-amino-3-methyl-N-ethyl-N-(β-hydroxyethyl)aniline sulfate, 4-amino-3-O-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat.

No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Emulsion Examples

Emulsion E-1:

A 180 L reactor charged with 52.7 kg of distilled water and containing 131 g of NaBr and 564 g of gelatin was adjusted to 70 C. The contents of the reactor were stirred vigorously throughout the precipitation process. 15.9 moles of AgI Lippmann emulsion were then dumped in and following a 4 minute hold, 1.25 M AgNO3 solution was run in at a linearly accelerated rate of 177 to 285 g/min over 9.4 minutes. Next, 1.25 M AgNO3 and 2.50 M NaBr solutions were added at linearly accelerated rates of 285 to 547 g/min and 116 to 416 g/min, respectively, for 21.8 minutes. Following this segment, 2.50 M AgNO3 and 2.50 M NaBr solutions were double jetted at accelerated rates of 313 to 1414 g/min and 416 g/min to 1272 g/min, respectively, over a 40.9 minute period. After this time, only the AgNO3 flow was continued and at a decelerated rate over the final 21.4 minutes during which the reactor vAg increased to +40 mv. The resulting emulsion grains (Emulsion E-1) had a mean equivalent circular diameter of 1.4 $\mu$m, and bromide accounted for 86% of the total emulsion halide.

The emulsion was optimally chemically and spectrally sensitized by adding KCl, NaSCN, $9.96\times10^{-5}$ mole/mole Ag of the blue sensitizing dye BSD-1 , $Na_2S_2O_3.5H_2O$, $Na_3Au(S_2O_3)_2.2H_2O$, and a benzothiazolium finish modifier. The emulsion was then subjected to a heat cycle to 65° C. The antifoggant-stabilizer, tetraazaindene, at a concentration of $8.71\times10^{-3}$ mole/mole silver, was added to the emulsion melt after the chemical sensitization procedure.

Host E-2:

To a solution of 10 g low methionine bone gelatin (methionine content <3 micromole per g gelatin), in 7.0 L distilled water and 46 mmole of NaBr at 40° C., pH 5.0 was added 0.10 mL of bromine water. To a vigorously stirred reaction vessel of this gelatin solution at 40° C., maintained at pH 5.0 throughout the precipitation, a 2.5 M $AgNO_3$ solution was added at 200 mL per min for 21 sec. Concurrently, a salt solution of 2.5 M NaBr and 0.4 g/L bromine was added initially at 200 mL per min and then at a rate needed to maintain a pBr of 2.11. Then the addition of the solutions was stopped, 82 mL of the salt solution was added in 1 min and the temperature of the contents of the reaction vessel was increased to 60° C. at a rate of 1.67° C. per min. Then all but 1.750 kg of the seed emulsion (0.042 mole Ag) was discarded. After the seed emulsion was at 60° C. for a total of 22 min, a solution preheated to 60° C. containing 100 g of oxidized bone gelatin, IL distilled water, 15.3 mL of 2 M NaBr and pretreated at 40° C. with 2.0 mL of bromine water was added. Then at 60° C., the $AgNO_3$ solution was added at 1.0 mL per min for 1 min then accelerated to 25 mL per min in 150 min and held at this flow rate until a total of 2,453 mL of the $AgNO_3$ solution was used. The salt solution was concurrently added until 240 mL of the $AgNO_3$ solution had been added, then a new salt solution of 2.5 M NaBr, 0.04 M KI to which 0.45 g per L of bromine was added was used to maintain a pBr of 1.44 throughout the rest of the precipitation. The total making time of the emulsion was 194 min. The emulsion was cooled to 40° C. and ultratiltered to a pBr of 2.65 Then 12.4 g per mole silver of bone gelatin (methionine content ~55 micromole per g gelatin) was added.

The {111} tabular grains had an average equivalent circular diameter of 3.8 $\mu$m, an average thickness of 0.07 $\mu$m, and an average aspect ratio of 54. The tabular grain population made up 99% of the total projected area of the emulsion grains.

Host E-3:

A starch solution was prepared by heating at 85° C. for 45 min a stirred mixture of 8 L distilled water and 160 g of an oxidized cationic waxy corn starch. (The starch derivative, STA-LOK® 140 is 100% amylopectin that had been treated to contain quaternary ammonium groups and oxidized with 2 wt % chlorine bleach. It contains 0.31 wt % nitrogen and 0.00 wt % phosphorous. It was obtained from A. E. Staley Manufacturing Co., Decatur, IL.) After cooling to 40° C., the weight was adjusted to 8.0 kg with distilled water, 26.5 mL of a 2 M NaBr solution was added, then while maintaining the pH at 5.0, 2.0 mL of saturated bromine water (~0.9 mmole) was added dropwise just prior to use.

To a vigorously stirred reaction vessel of the starch solution at 40° C. and maintained at pH 5.0 throughout the emulsion precipitation, a 2.5 M $AgNO_3$ solution was added at 200 mL per min for 21 sec. Concurrently, a salt solution of 2.5 M NaBr and 0.4 g/L bromine was added initially at 200 mL per min and then at a rate needed to maintain a pBr of 2.11. Then the addition of the solutions was stopped, 94 mL of the salt solution was added in I min and the temperature of the contents of the reaction vessel was increased to 60° C. at a rate of 1.67 ° C. per min. After holding at 60° C. for 10 min, 240 mL of the $AgNO_3$ solution was added at 10 mL per min for 1 min then its addition rate was accelerated to 19 mL per min in 12 min. The salt solution was concurrently added at a rate needed to maintain a constant pBr of 1.44. The additions were stopped and 40 mL of a buffer solution-consisting of 2.94 M sodium acetate and 1.00 M acetic acid was added. Then the addition of the $AgNO_3$ solution was accelerated from 19 to 54 mL per min in 45 min and then held at this flow rate until a total of 2.4 L of $AgNO_3$ solution had been added. A solution of 2.5 M NaBr, 0.04 M KI and 0.45 g per L of bromine was concurrently added to maintain a pBr of 1.44. The total making time of the emulsion was ~87 min.

The resulting tabular grain emulsion was washed by ultrafiltration at 30° C. to a pBr of 2.8. Then 27 g of bone gelatin (methionine content ~55 micromole per g gelatin) per mole silver was added.

The {111} tabular grains had an average equivalent circular diameter of 3.6 $\mu$m, an average thickness of 0.07 $\mu$m, and an average aspect ratio of 51. The tabular grain population made up 99% of the total projected area of the emulsion grains. This tabular grain emulsion was similar to Emulsion E2 in the measured grain parameters of average ECD, thickness, and proportion of tabular grains as a percentage of total grain projected area.

Host with Epitaxy

Epitaxy was deposited on the grains of each of Host E-2 and Host E-3 by the following procedure: A vigorously stirred 1.0 mole aliquot of the host emulsion was adjusted to a pAg of 7.59 at 40° C. by the addition of 0.25 M $AgNO_3$ solution. Then 5 mL of a 1M KI solution was added followed by 11 mL of a 3.77 M NaCl solution. Then the blue spectral sensitizing dye, anhydro-5,5'-dichloro-3,3'-bis(3-sulfopropyl)thiacyanine hydroxide, triethylammonium salt, was added in the form of a gelatin-dye dispersion in an amount of 80% of the saturation coverage of the grains' surfaces. After stirring for 25 min, 84 mL of a 0.25 M NaCl solution and 84 mL of a 0.25 M NaBr solution were added followed by 8 mmole of an AgI fine grain (~0.05 μm) emulsion To this mixture with vigorous stirring was added 0.5 M $AgNO_3$ at 76 mL per min for 1.1 min.

Electron microscopy analysis of the resulting emulsions showed the tabular grains had epitaxial deposits located primarily at the tabular grain corners and edges. As formulated these deposits had a nominal halide composition of 42 M % chloride, 42 M % bromide, and 16 M % iodide, based on silver.

Chemical Sensitization

Emulsions E-2 and E-3 were prepared from Hosts E-2 with epitaxy and E-3 with epitaxy respectively using the following procedure. To each of Hosts E-2 and E-3 with epitaxy were added with stirring at 40° C. solutions of (amount per mole silver) NaSCN (0.925 mmole), 1,3-dicarboxymethyl-1,3-dimethyl-2-thiourea, (the optimized level for each emulsion was found to be the same, 5.9 micromole), bis(1,4,5-trimethyl-1,2,4triazolium-3-thiolate) gold(I) tetrafluoroborate (the optimized level for each emulsion was found to be the same, 1.1 micromole), 3-{3-[(methylsulfonyl)amino]-3-oxopropyl} benzothiazolium tetrafluoroborate (the optimized level for each emulsion was found to be the same, 81 micromole). The emulsions were then heated at 50° C. for 10 minutes, cooled to 40° C., then sequentially 1-(3-acetamidophenyl)-5-mercaptotetrazole (0.489 mmole), and 4-hydroxy-6-methyl-1,3,3a,7-tetraazaindene (10 mmole) were added.

Emulsion E-2+FED2 and Emulsion E-3+FED2 To each of these sensitized emulsions were additionally added FED 2 (2.8 micromole per silver mole),

Multilayer Examples

Control Coating A-1:

The Multilayer Film Structure utilized for this example is shown below, with structures of components immediately following. Component laydowns are provided in units of gm/sq m. (Bisvinylsulfonyl)methane hardener at 1.55% of total gelatin weight. Antifoggants (including 4-hydroxy-6-methyl- 1,3,3a,7 -tetraazaindene), surfactants, coating aids, thickeners, coupler solvents, emulsion addenda, sequestrants, lubricants, matte and tinting dyes were added to the appropriate layers as is common in the art.

Layer 1 (Protective Overcoat Layer): gelatin at 0.888.

Layer 2 (UV Filter Layer): silver bromide Lippman emulsion at 0.215, UV-1 and UV-2 both at 0.108 and gelatin at 0.70.

Layer 3 (Fast Yellow Layer): blue sensitized silver iodobromide 3-D Emulsion E-1 coated at 1.33, YC-1 at 0.400, IR-1 at 0.065, B-1 at 0.011 and gelatin at 1.70.

Layer 4 (Slow Yellow Layer): a blend of three blue sensitized (both with a mixture of BSD-1 and BSD-2) tabular silver iodobromide emulsions (i) 1.3×0.14 μm, 2 mole % I at 0.356, (ii) 0.8×0.14 μm, 2.0 mole % I at 0.386, (iii)) 0.8×0.12 μm, 3.0 mole % I at 0.357,yellow dye forming coupler YC-1 at 0.725, IR-1 at 0.034 and gelatin at 1.7

Layer 5 (Yellow filter layer): YFD-1 at 0.108, OxDS-1 at 0.075 and gelatin at 0.807.

Layer 6 (Fast Magenta Layer): a green sensitized (with a mixture of GSD-1 and GSD-2) silver iodobromide tabular emulsions (3.9×0.14 μm, 4 mole % iodide) at 1.29, magenta dye forming coupler MC-1 at 0.087, IR-2 at 0.003 and gelatin at 1.60.

Layer 7 (Mid Magenta Layer): a green sensitized (with a mixture of GSD-1 and GSD-2) silver iodobromide tabular emulsions: (i) 2.9×0.12 μm, 3.7 mole % iodide at 0.969, magenta dye forming coupler MC-1 at 0.048, Masking Coupler MM-1 at 0.108, IR-2 at 0.011 and gelatin at 1.36.

Layer 8 (Slow magenta layer): a blend of two green sensitized (both with a mixture of GSD-1 and GSD-2) silver iodobromide tabular emulsions: (i) 0.88×0.12 μn, 2.6 mole % iodide at 0.527 and (ii) 1.2×0.12 μm, 4.1 mole % iodide at 0.353, magenta dye forming coupler MC-1 at 0.266, Masking Coupler MM-1 at 0.075 and gelatin at 1.18.

Layer 9 (Interlayer): OxDS-1 at 0.075 and gelatin at 0538.

Layer 10 (Fast Cyan layer): a red-sensitized sensitized (with a mixture of RSD-1 and RSD-2) iodobromide tabular emulsion (4.0×0.13 μm, 4.0 mole % I) at 0.130, cyan dye-forming coupler CC-2 at 0.181, IR-4 at 0.025, IR-3 at 0.022, OxDS-1 at 0.014 and gelatin at 1.45.

Layer 11 (Mid Cyan Layer): a red-sensitized sensitized (all with a mixture of RSD-1 and RSD-2) iodobromide tabular emulsion (2.2×0.12 μm, 3.0 mole % I) at 1.17, cyan dye-forming coupler CC-2 at 0.181, IR-3 at 0.022, IR-4 at 0.011, masking coupler CM-1 at 0.032, OxDS-1 at 0.011 and gelatin at 1.61.

Layer 12 (Slow cyan layer): a blend of two red sensitized (all with a mixture of RSD-1 and RSD-2) silver iodobromide emulsions: (i) a large sized iodobromide tabular grain emulsion (1.2×0.12 μm, 4.1 mole % I) at 0.258, (ii) a smaller iodobromide tabular emulsion (0.74×0.12), 4.1 mole % I) at 0.305, cyan dye-forming coupler CC-1 at 0.248, CC-2 at 0.363, masking coupler CM-1 at 0.032, bleach accelerator releasing coupler B-1 at 0.080 and gelatin at 1.67.

Layer 13 (Interlayer): OxDS-1 at 0.075 and gelatin at 0538.

Layer 14 (Antihalation layer): Black Colloidal Silver at 0.151, UV-1 and UV-2 both at 0.075 and gelatin at 1.61.

Support: transparent cellulose triacetate

Control Coating 2 is like Control Coating 1 with the following change:

Layer 3 (Fast Yellow layer): Emulsion E-2 was used instead of Emulsion E-1.

Control Coating 3 is like Control Coating 2 with the following change:

Layer 3 (Fast Yellow layer): FED-2 was added to Emulsion E-2 as specified in the description of the sensitization of Emulsion E-2.

Control Coating 4 is like Control Coating 2 with the following change:

Layer 3 (Fast Yellow layer): Emulsion E-3 was used instead of Emulsion E-2.

Example 5 is like Control Coating 4 with the following change:

Layer 3 (Fast Yellow layer): Emulsion E-3+FED2 was used instead of Emulsion E-3 alone.

Example Coating 6 is like Example Coating 5 with the following change:

Layer 3 (Fast Yellow layer): YC-1 was replaced with 0.140 game of OEC-12.

Blue Speed: Samples of each element were given a stepped exposure to a light source with a color temperature of 5500° K. and processed in the KODAK FLEXICOLOR (C-41) process as described in *British Journal of Photography Annual,* 1988, pp 196–198. Speed was measured in relative log units as 100*(1-logH) where H is the exposure in lux-sec necessary to produce a density 0.15 above D-min. Relative speed was set equal to 100 for the appropriate controls, see Tables 1 and 2. Thus a difference of 30 units would represent 0.3 log E or one stop of photographic speed (a doubling of speed).

Relative Blue RMS Granularity: Granularity of the blue layer in a neutral exposure was determined by the RMS method (see The Theory of the Photographic Process, $4^{th}$ Edition, T. H. James, pp 625–628) using a 48 micron aperture at a blue density of 1.8. RMS Granularity is the root-mean-squared standard deviation or local density variation in an area of overall uniform density. Relative Blue RMS granularity of neutral exposures reported in Tables 1 and 2 were calculated relative to the appropriate controls which were normalized to 100. Lower relative RMS granularity values ( i.e. <100) indicate a desirable improvement in photographic performance. A 6% reduction in relative RMS Granularity offers a just noticeable improvement in graininess as described by D. Zwick and D. Brothers, (*J. Soc. Mot. Pict Telev. Eng.,* v86, p427–430, 1977). RMS Granularity differences can also be correlated directly to photographic speed differences. A speed difference (relative to some control) when combined with the corresponding RMS granularity difference (which has been converted to the equivalent speed metric) is a measure of overall emulsion photoefficiency. The random dot model predicts that granularity is inversely proportional to the square root of the number of imaging centers (M. A. Kriss in *The Theory of the Photographic Process,* $4^{th}$ Ed. T. H. James, ed. New York, Macmillan, 1977; p625). Larger grains are usually needed to achieve higher speeds. For T-grain emulsions at constant thickness and constant silver laydown, as photographic speed increases 100% (1 stop or 0.3 loge ), RMS granularity will only increase by 50%. In other words, a 1% change in RMS Granularity will have a corresponding change in the speed metric of about 0.006 logE speed (i.e. 0.30 logE 150=0.006.

Red Acutance: To evaluate acutance, the film samples were exposed red light using to sinusoidal patterns to determine the Modulation Transfer Function (MTF) Percent Response as a function of spatial frequency in the film plane. Specific details of this exposure-evaluation cycle can be found at R. L. Lamberts and F. C. Eisen, "A System for the Automated Evaluation of Modulation Transfer Functions of Photographic Materials", in the Journal of Applied Photographic Engineering, vol. 6. Pages 1–8, February 1980. A more general description of the determination and meaning of MTF Percent Response curves can be found in the articles cited within this reference. The exposed samples were developed and bleached in the KODAK FLEXICOLOR (C-41) process. The exposed and processed samples were evaluated to determine the MTF Percent Response as a function of spatial frequency in the film plane. Table 2 shows the MTF Percent Response characteristics of the cyan dye images formed by the red light sensitive layers of the described photographic multicolor elements. Higher MTF % Response indicates improved film acutance.

TABLE 1

Multilayer Results

| Coating | Layer 3 Fast Yellow Emulsion | Layer 3 FY Silver ($g/m^2$) | Blue * Dmin | Blue Speed | Relative Blue RMS Granularity |
|---|---|---|---|---|---|
| Control 2 | E-2 | 0.67 | 0.993 | 100 | 100 |
| Control 3 | E-2 + FED-2 | 0.67 | 1.015 | 119 | 103 |
| Control 4 | E-3 | 0.67 | 0.928 | 105 | 100 |
| Example 5 | E-3 + FED-2 | 0.67 | 0.930 | 127 | 91 |

(*) These large Dmins are expected for a multilayer with masking couplers.

A comparison of the data for coatings Controls 2 and 3 of Table 1 shows the gel precipitated emulsion (E-2) gained 0.19 loge blue speed [119–100=19 or 0.19 logE] with the addition of FED-2. Addition of FED-2 to the gel precipitated emulsion also increased RMS Granularity by 3% (103–100=3%, not observable nor significant), which would equate to only +0.02 logE speed [3%×0.006=+0.02 logE]. Summing the blue speed increase with the speed equated to the small granularity increase (degradation) yielded an overall 0.17 logE (0.19–0.02=0.17 logE) improvement in equivalent blue speed-grain or photoefficiency for the gel precipitated emulsion treated with FED-2.

A comparison of the data for coatings Control 4 and Example 5 shows the starch precipitated emulsion (E-3) gained 0.22 loge blue speed [127–105=22 or 0.22 logE] with the addition of FED-2. Addition of FED-2 to the starch precipitated emulsion surprisingly gave a 9% reduction (improvement) in RMS Granularity (91–100=–9%, a significant and a noticable difference), which would equate to 0.05 logE speed [9%×0.006=+0.05 logE]. Summing the blue speed increase with the speed equated to the granularity reduction gave an overall 0.27 logE (0.22+0.05=0.27 logE) improvement in blue speed-grain or photoefficiency for the starch precipitated emulsion treated with FED-2.

This demonstrated that emulsions precipitated in starch and treated with FED-2 have a greater speed or photoefficiency boost than comparable emulsions precipitated in gel and treated with FED2 [+0.27 logE vs 0.17 logE]. The emulsion precipitated in starch also had considerably lower Dmin that the emulsion precipitated in gel. This 0.1 log E or 25% represents a significant and unexpected beneficial interaction in using a fragmentable electron donor with high speed, large tabular AgBrI emulsions made in starch compared to those made in gelatin for multilayer photographic systems.

TABLE 2

Multilayer Results

| Variation | Layer 3 Fast Yellow Emulsion | FY Silver (g/m2) | Blue Dmin | Blue Speed | Relative* Blue RMS Granularity | MTF % Response** Red Sensitive Layer Cycles/mm 5 | 10 | 20 | 60 |
|---|---|---|---|---|---|---|---|---|---|
| Control-1 | E-1 | 1.33 | 1.030 | 100 | 100 | 93.3 | 74.2 | 49.2 | 8.4 |
| Control-4 | E-3 | 0.67 | 0.928 | 57 | 84 | 94.5 | 86.0 | 60.6 | 16.8 |

TABLE 2-continued

Multilayer Results

| Variation | Layer 3 Fast Yellow Emulsion | FY Silver (g/m2) | Blue Dmin | Blue Speed | Relative* Blue RMS Granularity | MTF % Response** Red Sensitive Layer Cycles/mm 5 | 10 | 20 | 60 |
|---|---|---|---|---|---|---|---|---|---|
| Example 5 | E-3 + FED-2 | 0.67 | 0.930 | 79 | 77 | 94.1 | 86.1 | 60.3 | 16.0 |
| Example 6 | E-3 + FED-2 + YC-3 | 0.67 | 0.936 | 86 | 67 | 94.3 | 86.0 | 60.6 | 16.7 |

(*) Relative Blue RMS Granularity was measured at a blue density of 1.8 using a 48 um aperature
(**) MTF % Response were measured at a red density of 1.0

The results in Table 2 also show that, when used as high speed blue emulsions, large tabular AgBrI emulsions (Control4, E-3) are substantially inferior to 3D emulsions (Control-1, E-1) for photographic sensitivity (speed). When used as high speed blue emulsions, large tabular AgBrI emulsions generally have superior acutance in underlying layers (eg Control-4 and Examples 5 and 6). It would be desirable to retain the acutance advantage and granularity advantage associated with the use of large high speed tabular AgBrI emulsions in addition to the speed associated with 3D emulsions. With the addition of a fragmentable electron donor such as FED-2 and one equivalent couplers such as YC-3, these large tabular grains can be brought up to acceptable sensitivity for high speed applications (Example 6). FED-2 added 0.22 logE speed to the large E-3 tabular AgBrI emulsion made in starch [79−57=22 or 0.22 loge speed, Example 5 vs Control 4] and the one equivalent coupler YC-3 added another 0.07 logE speed [86−79=7 or 0.7 logE, Examples 6 vs 5]. While the blue speed of the T-grain emulsion precipitated in starch (E-3) in combination with FED-2 and YC-3 (Example 6) had inferior speed relative to the 3D control emulsion (E-1, Control-1) by −0.14 log E [84−100=−14 or −0.14 logE], that overall photoefficiency gap was more than eliminated when the RMS granularity differences were converted into speed. It is particularly significant and totally unanticipated that as the T-grain emulsion precipitated in starch (E-3) increased in speed with the addition of the FED-2 and independently with the addition of the 1 Equivalent coupler YC-3 the granularity also improved with the addition successive additions of FED-2 and YC-3 ( from 84 to 7 to 67). Thus the T-grain emulsion precipitated in starch (E-3) showed a 33% RMS granularity reduction relative to the control (67−100=−33%, −33%×0.006=+0.20 log E, Example 6 vs Control-1 Table 2) in combination with FED-2 and YC-3. When RMS granularity was considered, the T-grain emulsion precipitate in starch, with FED-2 and YC-3 (Example-6) had +0.06 logE higher overall speed or photoefficiency relative to the 3D emulsion (Control-1) [100−84=−0.14 logE speed deficit which is offset by +0.20 logE from granularity=+0.06 log E].

These observations indicate an unexpected beneficial interaction between the fragmentable electron donor, one equivalent coupler and large tabular AgBrI emulsion made with starch. In addition to this speed-grain improvement there was also a 50% reduction in fast yellow silver laydown, lower blue Dmin, and a demonstrable improvement in MTF response of underlying layers of the multilayer film.

Chemical Structures

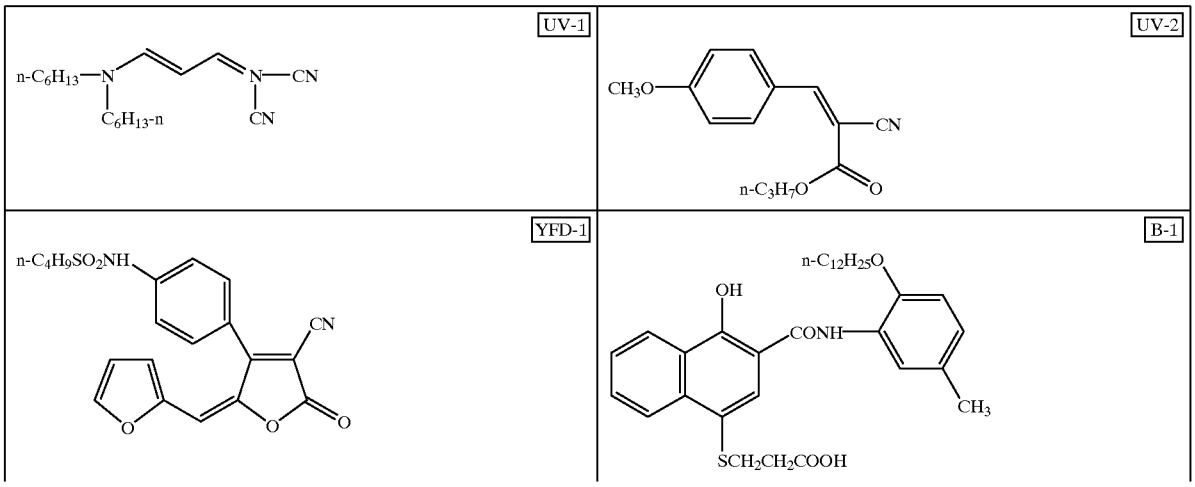

-continued
YC-1
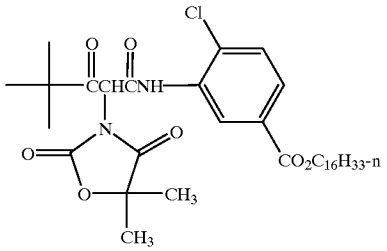
MC-1
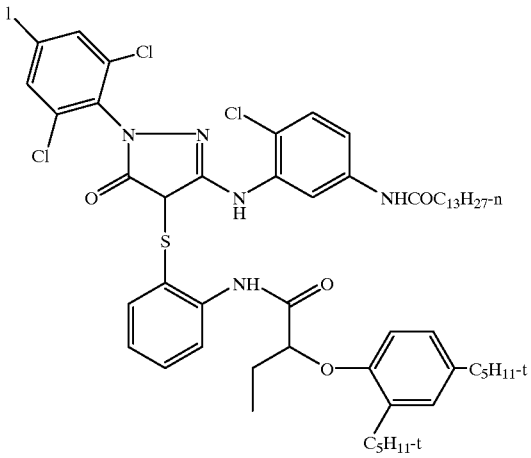
CC-1
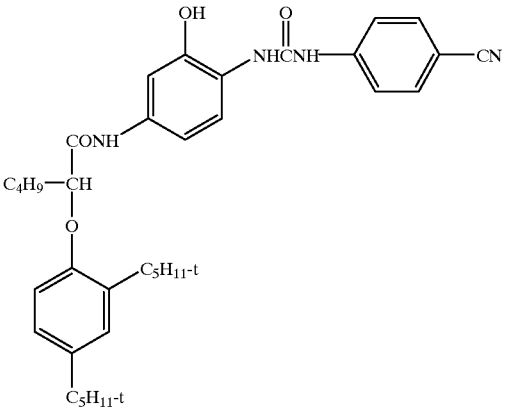
CC-2
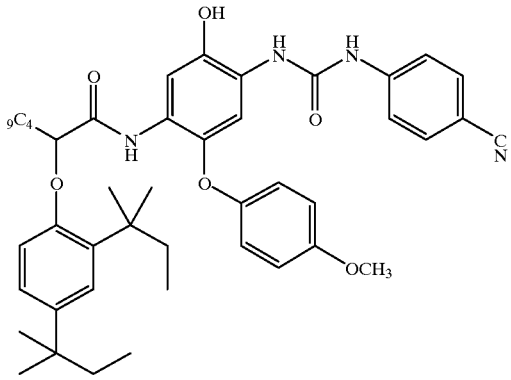
MM-1
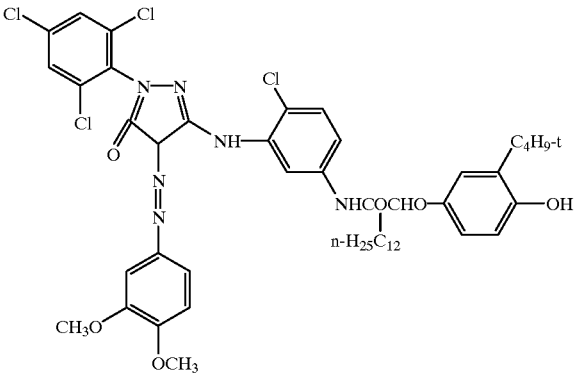
CM-1
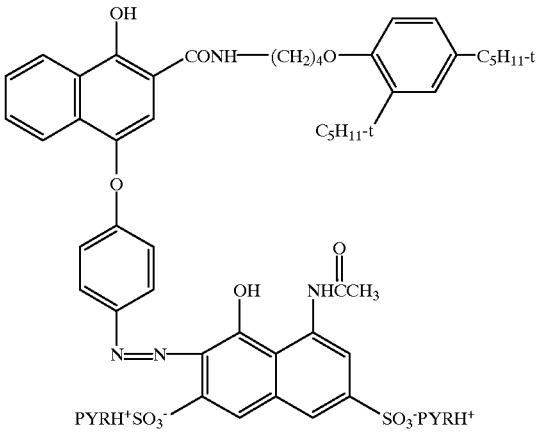

-continued
OxDS-1
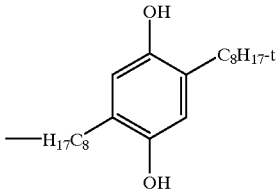
IR-1
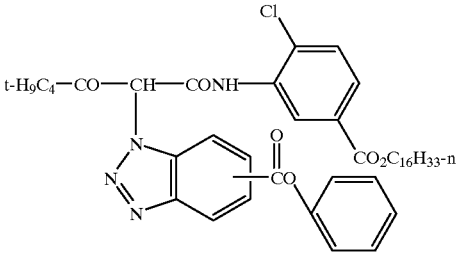
IR-2
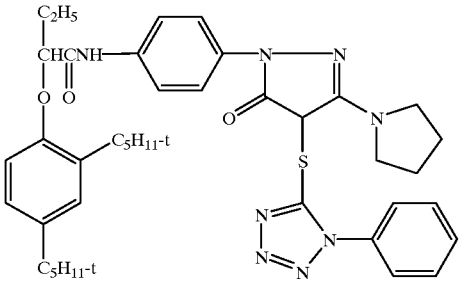
IR-3
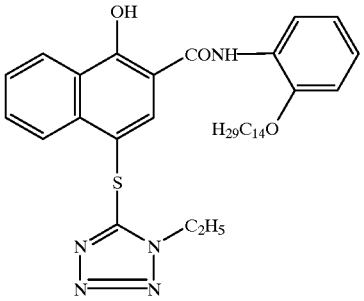
IR-4
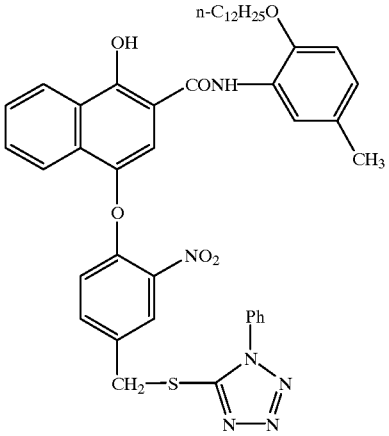
FED-2
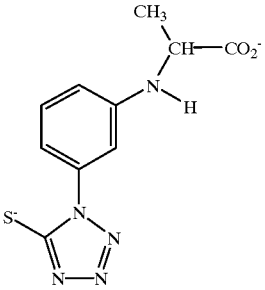
BSD-1
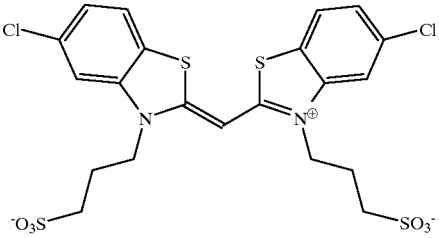
BSD-2
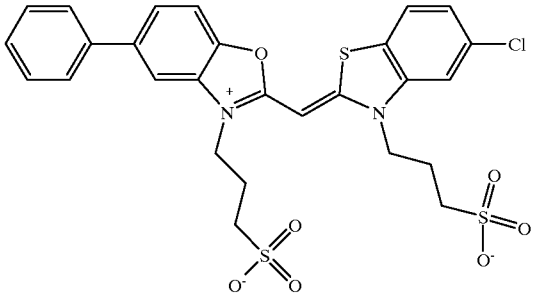

-continued

GSD-1

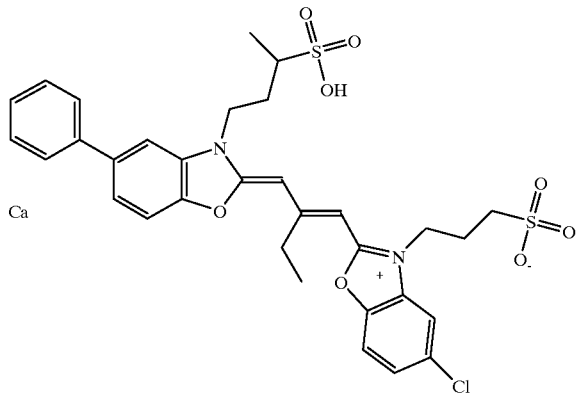

GSD-2

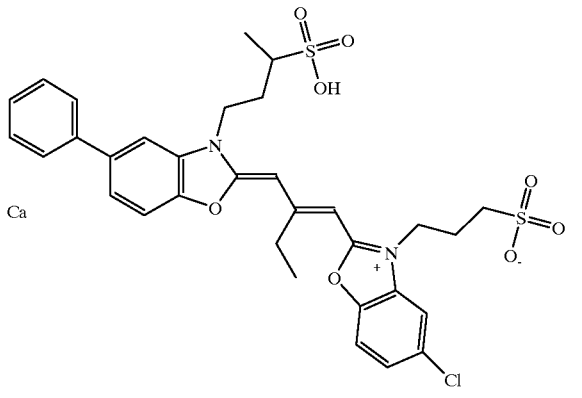

RSD-1

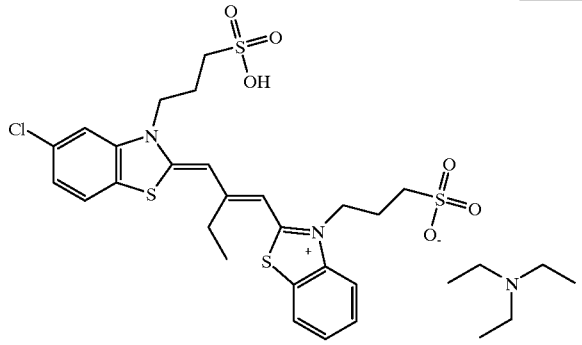

RSD-2

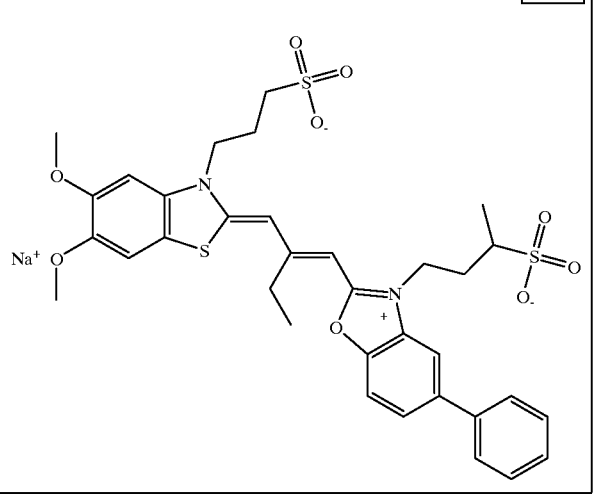

The invention has been described in detail with particular reference to certain preferred embodiments thereof, but it will be understood that variations and modifications can be effected within the spirit and scope of the invention.

What is claimed is:

1. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said emulsion layers comprises tabular grains having {111} major faces containing greater than 50 mole percent bromide, and accounting for greater than 50 percent total grain projected area precipitated in a peptizer that is a water dispersible cationic starch, and contains a fragmentable electron donating sensitizer.

2. A photographic element according to claim 1, wherein the tabular grains have an equivalent circular diameter of at least 2 $\mu$m.

3. A photographic recording element according to claim 1 wherein the emulsion precipitated in a water dispersible cationic starch is additionally precipitated in the presence of an oxidizing agent capable of oxidizing metallic silver.

4. A photographic recording element according to claim 1 wherein the layer containing an emulsion precipitated in a water dispersible cationic starch is sensitized to blue light.

5. A photographic element according to claim 1, wherein an emulsion layer containing an emulsion precipitated in a water dispersible cationic starch additionally contains at least one, one-equivalent coupler.

6. A photographic element according to claim 5, wherein the one-equivalent coupler is of the formula:

$$\text{COUP-L}'_n\text{—B'—N}(R_{23})\text{-DYE}$$

wherein:

COUP is the coupler moiety;

DYE is an image dye or image dye precursor;

$L'_n$—B' is a group that is at least divalent;

B' is —OC(O)—, —OC(S)—, —SC(O), —SC(S)— or —OC(=$NSO_2R_{24}$)-, where $R_{24}$ is a substituted or unsubstituted alkyl or aryl group;

L' is a linking group;

$R_{23}$ is a substituent; and n is zero or 1.

7. A photographic element according to claim 6, wherein COUP is a cyan dye-forming moiety, a magenta dye-forming moiety or a yellow dye-forming moiety.

8. A photographic element according to claim 6, wherein $-L'_nB'-$ selected from the following groups:

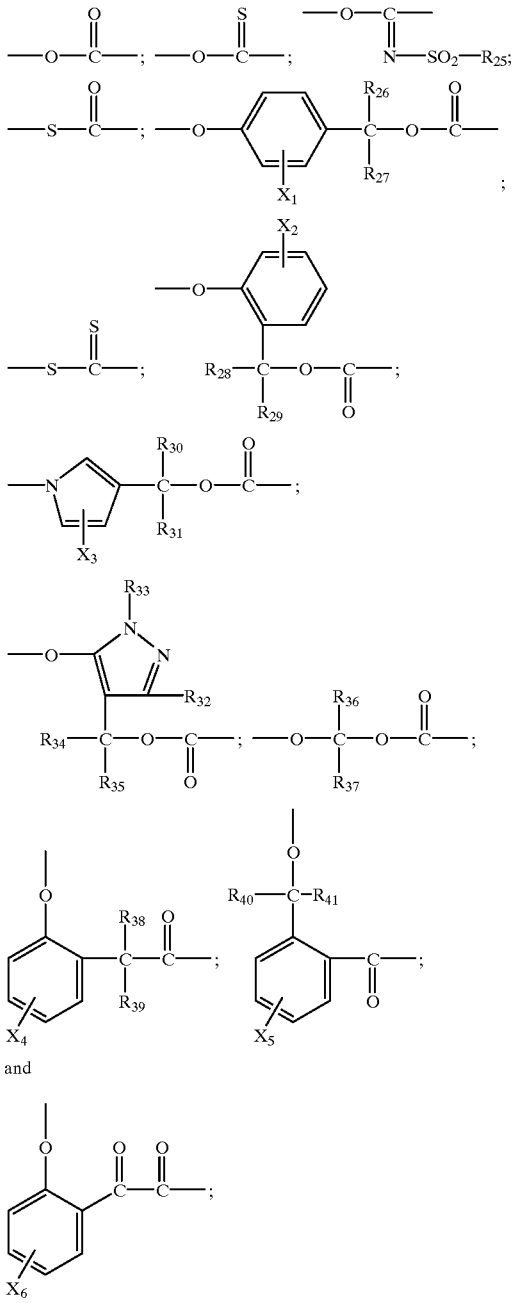

and wherein $R_{25}$ through $R_{24}$ are individually a hydrogen atom or an unsubstituted or substituted alkyl, cycloalkyl, or aryl group, and $X_1$ through $X_6$ are individually a hydrogen halogen atom or a substituted or unsubstituted alkyl, nitro, carbamyl, acylamido, sulfonamido, sulfamyl, sulfo, carboxyl, cyano, alkoxy, or aryloxy group.

9. A photographic element according to claim 6, wherein DYE is an azomethine or methine dye.

10. A photographic element according to claim 5 wherein DYE includes an auxochrome or chromophore, and $N(R_{23})$ forms a part of said auxochrome or chromophore.

11. A photographic element according to claim 6, wherein $R_{23}$ is hydrogen, unsubstituted or substituted alkyl, cycloalkyl, or aryl.

12. A photographic element according to claim 1, wherein the fragmentable electron donating sensitizer is a compound of the formula: X-Y' or a compound which contains a moiety of the formula: -X-Y';

wherein:

X is an electron donor moiety, Y' is a leaving proton H or a leaving group Y, with the proviso that if Y' is a proton, a base, β'; is present in said emulsion layer or is covalently linked directly or indirectly to X, and wherein:

1) X-Y' has an oxidation potential between 0 and about 1.4 V; and 2) the oxidized form of X-Y' undergoes a bond cleavage reaction to give the radical $X^{\bullet}$ and the leaving fragment Y'; and, optionally, 3) the radical $X^{\bullet}$ has an oxidation potential $\leqq -0.7$ V.

13. A photographic element according to claim 12, wherein X is of structure (I):

(I)

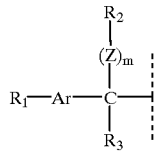

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-wherein:

m=0, 1;

Z=O, S, Se, Te;

$R_2$ and Ar can be linked to form 5- to 8-membered ring;

$R_3$ and Ar=can be linked to form 5- to 8-membered ring;

Ar'=aryl group or heterocyclic group;

and

R=a hydrogen atom or an unsubstituted or substituted alkyl group.

14. A photographic element according to claim 12, wherein X is a compound of structure (II):

(II)

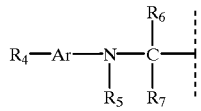

wherein:

Ar=aryl group or heterocyclic group $R_4$=a substituent having a Hammett sigma value of −1 to +1, $R_5$=R or Ar'

$R_6$ and $R_7$=R or Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group or heterocyclic group;

and

R=hydrogen atom or an unsubstituted or substituted alkyl group.

15. A photographic element according to claim 12, wherein X is a compound of structure (III):

(III)

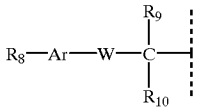

wherein:

W=O, S, Se;

Ar=aryl group or heterocyclic group;

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group or heterocyclic group;

and

R=a hydrogen atom or an unsubstituted or substituted alkyl group.

16. A photographic element according to claim 12, wherein X is of structure (IV):

(IV)

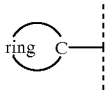

wherein:

"ring" represents a substituted or unsubstituted 5-, 6- or 7-membered unsaturated ring.

17. A photographic element according to claim 12, wherein Y' is:

(1) X', where X' is an X group as defined in structures I–IV and may be the same as or different from the X group to which it is attached (2)

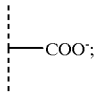

(3)

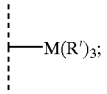

-continued where M = Si, Sn or Ge; and R' = alkyl or substituted alkyl;

(4)

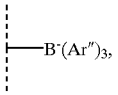

where Ar'' = aryl or substituted aryl; or (5)

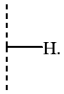

18. A photographic element according to claim 12, wherein fragmentable electron donor compound is selected from compounds of the formulae:

$Z\text{-}(L\text{-}X\text{-}Y')_k$ $A\text{-}(L\text{-}X\text{-}Y')_k$ $(A\text{-}L)_k\text{-}X\text{-}Y'$ $Q\text{-}X\text{-}Y'$ $A\text{-}(X\text{-}Y')_k$ $(A)_k\text{-}X\text{-}Y'$ $Z\text{-}(X\text{-}Y')_k$ or $(Z)_k\text{-}X\text{-}Y'$ wherein:

X is an electron donor moiety, Y' is a leaving proton H or a leaving group

Y, with the proviso that if Y' is a proton, a base, $\beta^-$, is present in said emulsion layer or is covalently linked directly or indirectly to X, Z is a light absorbing group;

k is 1 or 2;

A is a silver halide adsorptive group;

L represents a linking group containing at least one C, N, S, P or O atom; and

Q represents the atoms necessary to form a chromophore comprising an amidinium-ion, a carboxyl-ion or dipolar-amidic chromophoric system when conjugated with X-Y'.

* * * * *

UNITED STATES PATENT AND TRADEMARK OFFICE

CERTIFICATE OF CORRECTION

PATENT NO. : 6,225,036 B1
DATED : May 1, 2001
INVENTOR(S) : Joe E. Maskasky et al.

It is certified that error appears in the above-identified patent and that said Letters Patent is hereby corrected as shown below:

Column 75, claim 8,
Line 57, delete "$R_{24}$" and substitute -- $R_{41}$ --

Signed and Sealed this

Twenty-ninth Day of January, 2002

*Attest:*

*Attesting Officer*

JAMES E. ROGAN
*Director of the United States Patent and Trademark Office*